US006264500B1

(12) United States Patent
Kawabe

(10) Patent No.: US 6,264,500 B1
(45) Date of Patent: Jul. 24, 2001

(54) ELECTRICAL CONNECTOR WITH CABLE GUIDE SLOT

(75) Inventor: Eiji Kawabe, Sagamihara (JP)

(73) Assignee: I-Pex Co., Ltd., Tokyo (JP)

( * ) Notice: Subject to any disclaimer, the term of this patent is extended or adjusted under 35 U.S.C. 154(b) by 0 days.

(21) Appl. No.: 09/034,287

(22) Filed: Mar. 4, 1998

(30) Foreign Application Priority Data

Mar. 6, 1997 (JP) ..... 9-051682
Mar. 24, 1997 (JP) ..... 9-069701
Jun. 30, 1997 (JP) ..... 9-174071

(51) Int. Cl.[7] ..... H01R 12/24
(52) U.S. Cl. ..... 439/496; 439/607
(58) Field of Search ..... 439/495, 496, 439/497, 607, 579, 455, 466, 470, 393, 492, 856, 857, 623, 472

(56) References Cited

U.S. PATENT DOCUMENTS 3,253,248 * 5/1966 Brown .
3,667,101 * 6/1972 Kloth ..... 439/623 X
3,696,319 * 10/1972 Olsson ..... 439/496
4,365,856 * 12/1982 Yaegashi et al. ..... 439/497
5,327,641 7/1994 Olsson ..... 29/747
5,897,394 * 4/1999 Adachi ..... 439/496

FOREIGN PATENT DOCUMENTS 431432 9/1991 (EP) .

OTHER PUBLICATIONS

Great Britain 9804702.0 Search Report completed Sep. 24, 1998.

* cited by examiner

*Primary Examiner*—Neil Abrams
(74) *Attorney, Agent, or Firm*—Varndell & Varndell, PLLC

(57) ABSTRACT

A cable holder of an electric connector is formed with a plurality of cable guide slots at a prescribed interval and bent in U-shape, along which cable conductors are arranged. The cable conductors are positioned in alignment members which are located in recesses on opposite sides of the cable holder. The cable conductor bent in U-shape in the cable guide slots are used as a plug of the electric connector. A receptacle of an electric connector is covered with a receptacle shield cover with the portion opposite a printed circuit board being removed, while shielding conductive pattern is formed on the portion of the printed circuit board opposite the receptacle so that the entire exterior of the receptacle is covered with the shielding conductive pattern on the printed circuit board and the receptacle shield cover.

14 Claims, 22 Drawing Sheets

ELECTRICAL CONNECTOR WITH CABLE GUIDE SLOT

BACKGROUND OF THE INVENTION

1. Field of the Invention

The present invention relates to an electric connector used in small electronic devices, such as notebook computers, and more particularly to an electric connector for effecting electrical connections of a plurality of extra-fine cables.

2. Description of the Related Art

Before now, a plurality of extra-fine cables was used for the internal wiring of small electronic devices, such as notebook computers.

Some known examples of such a plurality of extra-fine cables (referred to below simply as "cables") are the following: a bundle of a plurality of single cables wherein extra-fine conductors are contained in insulators, a flexible flat cable wherein a row of a plurality of extra-fine conductors is contained in an insulator, or a bundle of a plurality of extra-fine coaxial cables.

Meanwhile, an electric connector is used as an apparatus to connect each of such a plurality of cables to each terminal formed on a printed circuit board.

This electric connector is constituted of a receptacle having a plurality of female contacts and a plug having a plurality of male contacts corresponding to the plurality of female contacts, and causes the male contacts to fit into the corresponding female contacts to contrive an electrical connection between the male and female contacts.

Before now, in order to connect a corresponding plurality of cables to each of the male contacts established in this plug, the conductor of each cable was soldered to the corresponding male contact or each cable conductor was bonded by pressure one by one, to each corresponding male contact by means of a pressure-bonding tool.

However, with such a conventional electric connector in which the soldering work or pressure-bonding work must be performed to form an electrical connection between each cable conductor and each male contact, these works are troublesome and are also a factor in erroneous wiring.

Also, with a conventional electric connector, a large amount of space is occupied by the soldered portion or pressure-bonded portion as a result of connecting each cable conductor with each male contact by the soldering process or pressure-bonding process. For this reason, it is difficult to decrease the interval between each of the male contacts and thereby it is difficult to contrive the miniaturization of the electric connector itself.

Also, another well-known example of the conventional electric connector is a so-called RA-style electric connector, wherein a plug is fitted from a direction parallel to the printed circuit board to a receptacle installed on a printed circuit board.

These types of electric connectors include those where metal shield covers are installed on both the plug and receptacle, to prevent as much as possible effects of damage from electromagnetic waves.

FIG. 25 is a schematic perspective view of a conventional electric connector 81 with a shield cover of an RA-style electric connector wherein metal shield covers are installed on both the plug and receptacle to prevent as much as possible effects of damage from electromagnetic waves.

The electric connector 81 comprises a receptacle 83, wherein a plurality of male contacts 82 are installed in a row, and a plug 84, wherein female contacts are installed in a row so as to be opposite to each of the male contacts 82 in the receptacle 83.

The receptacle 83 is constituted from a receptacle housing 85 in which the plurality of male contacts 82 is aligned in a row at a prescribed interval, and a rectangular receptacle shield cover 86 made of a metal plate and installed to surround the periphery of the receptacle housing 85. A pair of tongue pieces 86*a* is formed as part of this receptacle shield cover 86 on both sides thereof. This pair of tongue pieces 86*a* is mounted on rectangular conductive pattern 88, formed on the printed circuit board 87 at positions opposite to the tongue pieces 86*a*, and affixed thereto by an affixation process such as soldering. The conductive pattern 88 is connected to a ground, not shown in the drawings.

Meanwhile, as shown in FIG. 25 and FIG. 26 which shows a cross section of the plug 84 installed in the receptacle 83, the plug 84 is constituted of a plug housing 90 and a rectangular plug shield cover 91. In the plug housing 90, a plurality of female contacts 89, each having a two-pronged end in which each of the aforementioned male contacts 82 is inserted and supported, is aligned in a row and at a prescribed interval. The rectangular plug shield cover 91 is made of a metal plate installed to surround the periphery of the plug housing 90.

Pairs of tongue pieces 91*a*, 91*b* are formed on the upper and lower surfaces of the plug shield cover 91. Each of the tongue pieces 91*a*, 91*b* is in sliding contact with the upper or lower surfaces of the receptacle shield cover 86, when the plug 84 is installed as shown in FIG. 26, and ensures electrical conductivity with the receptacle shield cover 86.

In FIGS. 25 and 26, the reference number 92 shows a bundle of a plurality of cables connected to each of the female contacts 89.

However, a disadvantage of the conventional electric connector 81 with a shield cover is that it is not possible to reduce the thickness of a small electronic device such as a portable phone which uses the electric connector 81 with such a shield cover. This is because, as shown in FIG. 25, the receptacle 83 is covered on its periphery with the receptacle shield cover 86 and as a result, as shown in FIG. 26, the height H of the receptacle 83 is increased by the thickness of the receptacle shield cover 86 on the upper and lower surfaces.

SUMMARY OF THE INVENTION

It is an object of the present invention to provide an electric connector which can easily connect a plurality of cables and further reduce the interval between the contacts.

Further, it is another object of the present invention to provide an electric connector with a shield cover wherein the height of the receptacle is reduced as much as possible.

To resolve the foregoing issues in the conventional electric connectors, an electric connector of the first invention is provided a non-conductive cable holder having a plurality of cable guide slots at a prescribed interval and formed in U-shape along a forward direction; this cable holder is formed in U-shape by being disposed along the aforementioned plurality of cable guide slots corresponding to each of the cable conductors extending from each of the cable terminals of a plurality of cables. The electric connector is also provided a receptacle having a plurality of female contacts for holding each of the cable conductors disposed in the cable guide slots and forming electrical connections with the corresponding cable conductors.

An electric connector of the second invention is an electric connector with a shield cover, comprising a receptacle covered with a receptacle shield cover and disposed on a printed circuit board and a plug covered with a plug shield cover and inserted in the aforementioned receptacle. The electric connector of the second invention is constituted so that the receptacle is covered with the receptacle shield cover, but with the side of the shield cover opposite the printed circuit board removed; shielding conductive pattern to cover all of one side of the receptacle is formed on the portion of the printed circuit board opposite the receptacle. Thus, the entire receptacle is covered by the shielding conductive pattern and the receptacle shield cover.

Other objects and effects of the present invention can be easily confirmed with the following detailed explanation and appended figures.

DESCRIPTION OF THE PREFERRED EMBODIMENTS

Embodiments of the electric connector according to the first invention and embodiments of the electric connector according to the second invention are described below in detail.

Figure 1:
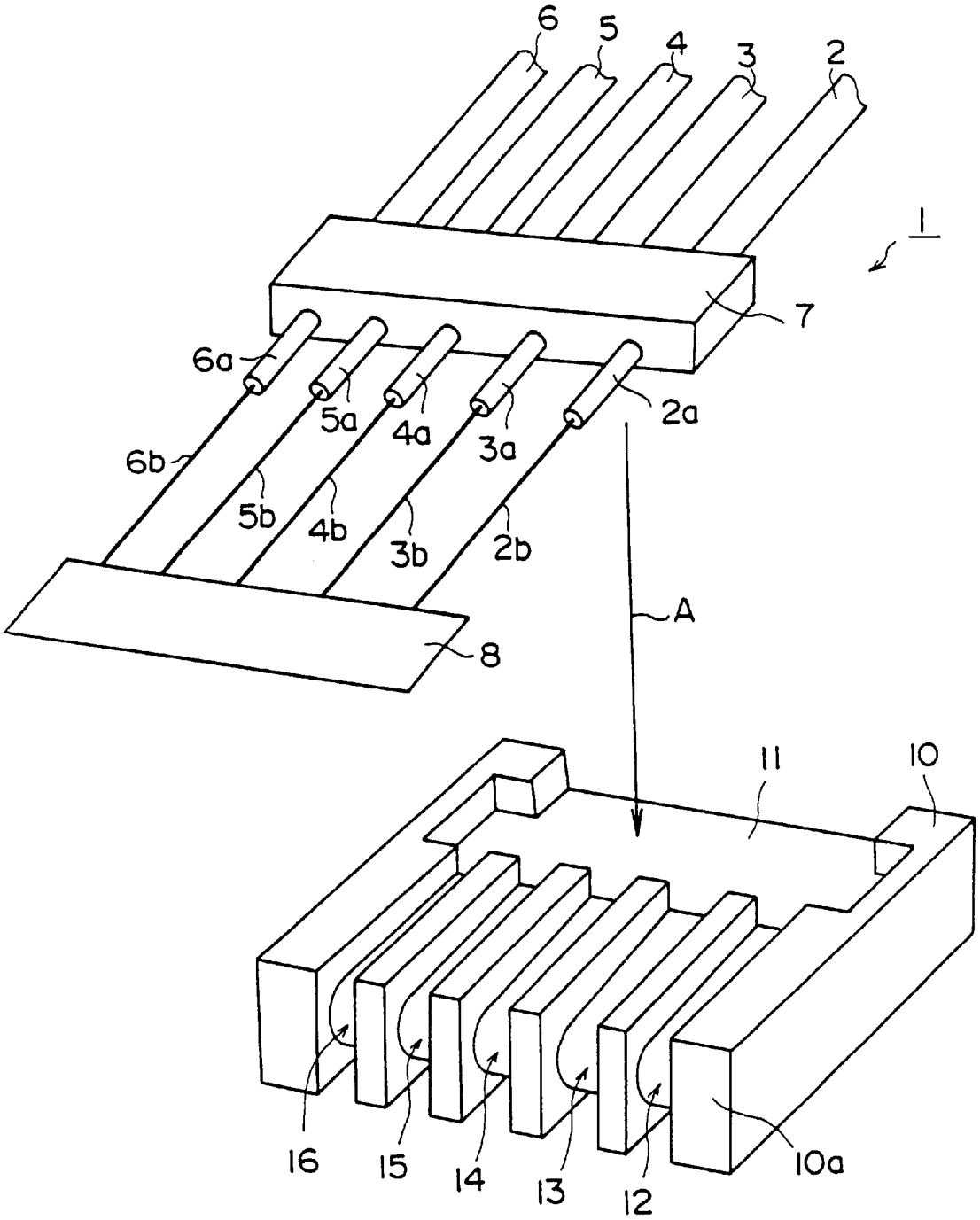
FIG. 1 is a perspective view showing the assembly of a cable holder of the electric connector according to an embodiment of the present invention.

FIG. 1 is a schematic perspective view of the principal elements of an electric connector 1 showing a first embodiment according to the first invention.

The electric connector 1 of the first embodiment comprises a non-conductive cable aligning member 7 to align each of the end portions 2*a*–6*a* of a plurality of extra-fine cables 2–6 in a flat row at a prescribed interval. The end portions of each cable conductor 2*b*–6*b*, extending from each of these end portions 2*a*–6*a*, are pressure-bonded by a laminate 8, which is a cable aligning member formed of an insulator to align each of these end portions in a row at a prescribed interval.

On the other hand, a cable holder 10, to align the cable conductors 2*b*–6*b* of these extra-fine cables 2–6 in a row at a prescribed interval, is formed of an insulator. A depressed portion 11 to house and set the position of the cable aligning member 7 is formed on the upper surface thereof.

A plurality of U-shaped cable guide slots 12–16 is formed on this cable holder 10 and adjacent to the depressed portion 11. These U-shaped cable guide slots 12–16 are formed at a prescribed interval to bend the cable conductors 2*b*–6*b* extending from the cable aligning member 7, without causing them to contact each other, in U-shape in a forward direction facing the end surface 10a of the cable holder 10.

With such a cable holder 10, the cable aligning member 7 is housed with its position being set in the depressed portion 11 as shown with the arrow A in FIG. 1. After that, the cable conductors 2*b*–6*b* of the extra-fine cables 2–6 are guided by the corresponding cable guide slots 12–16.

Figure 2:
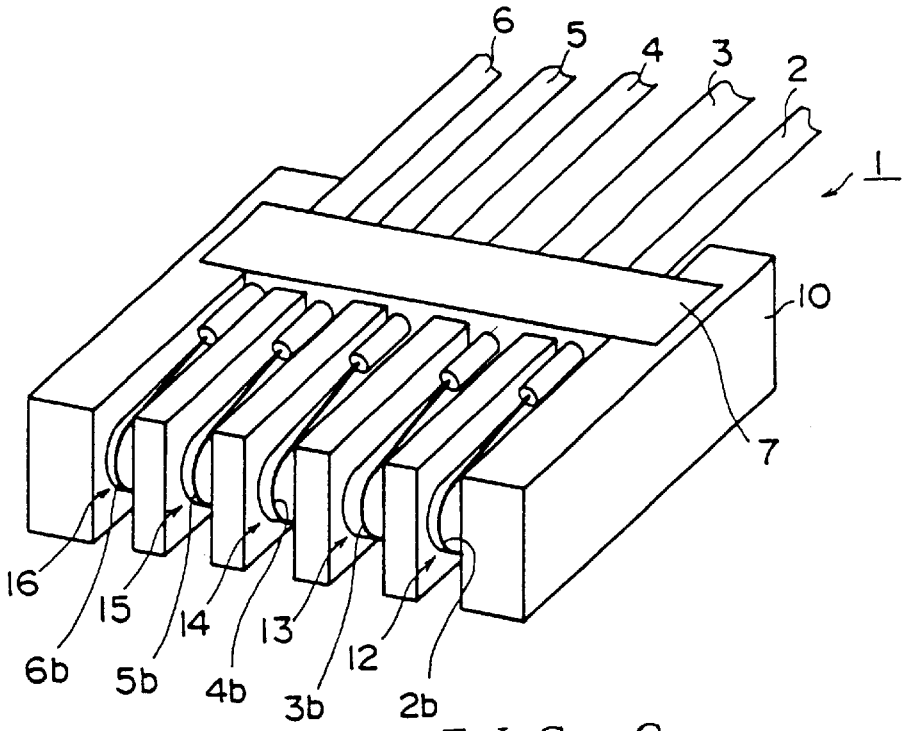
FIG. 2 is a schematic perspective view showing the cable holder after assembly is complete.

FIG. 2 shows that the cable conductors 2*b*–6*b* are aligned in a row and bent in U-shape along the plurality of corresponding cable guide slots 12–16.

Figure 3:
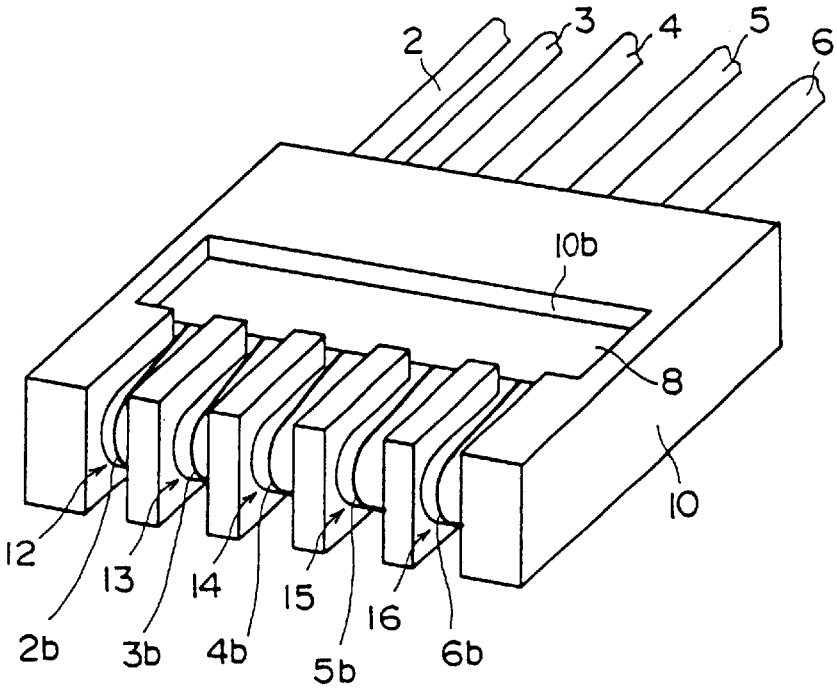
FIG. 3 is a schematic perspective view showing another side of the cable holder after assembly is complete.

Further, as shown in FIG. 3 showing the back of FIG. 2, in this embodiment, the laminate 8, to join the end portions of the cable conductors 2*b*–6*b*, is supported with its position being set in a depressed portion 10*b* formed on the back surface of the cable holder 10.

Figure 4:
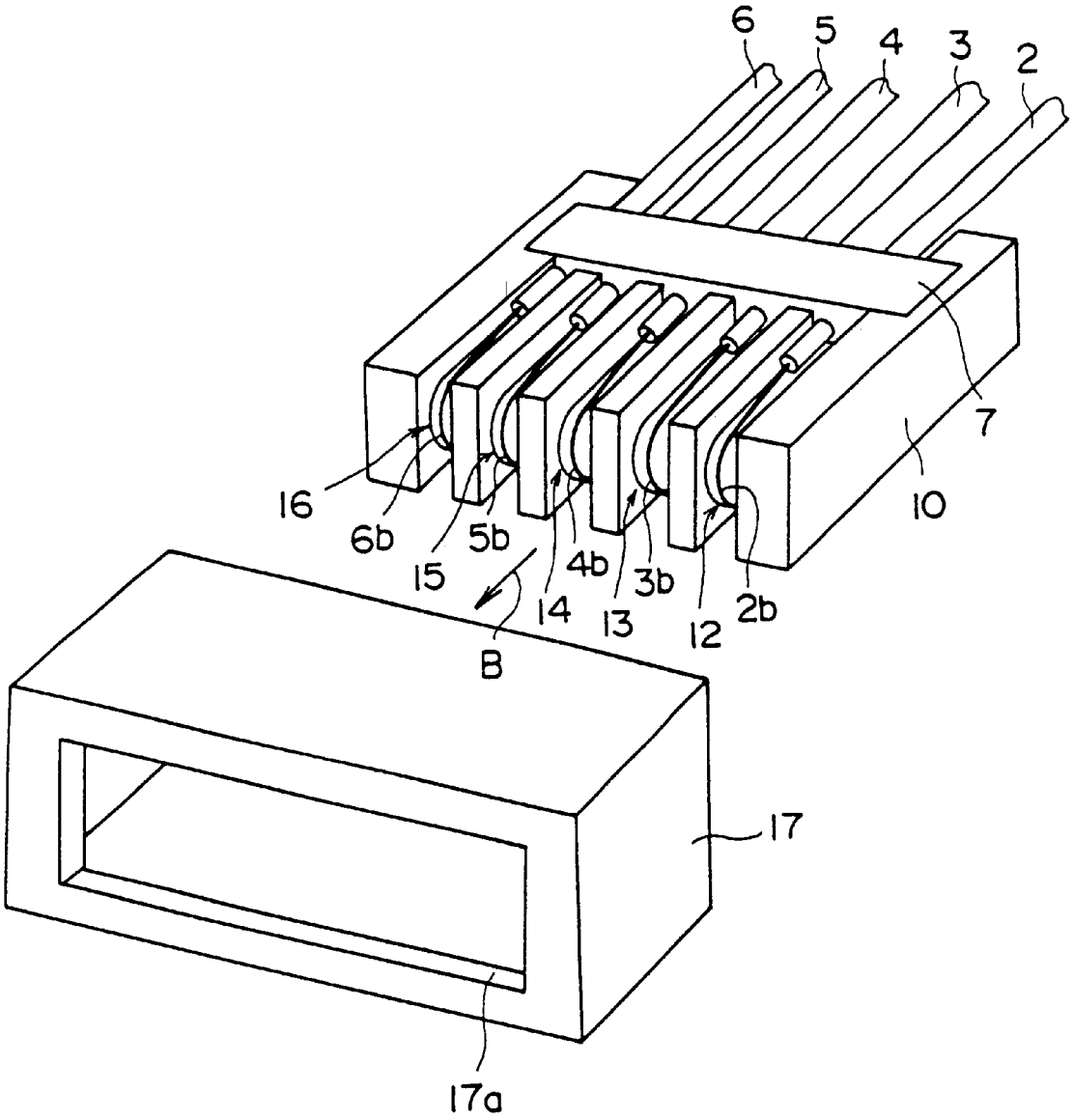
FIG. 4 is a perspective view showing the installation of the cable holder in the holder cover.

As shown by the arrow B in FIG. 4, the cable holder 10, which bends the cable conductors 2*b*–6*b* in U-shape along the cable guide slots 12–16, is installed in the holder cover 17 having an opening 17*a* on the front. The holder cover 17 prevents the cable aligning member 7 and laminate 8 (FIG. 3) from dropping from each of the depressed portions 11, 10*b*, and in other words, prevents the release of the U-shaped bend of the cable conductors 2*b*–6*b*.

Figure 5:
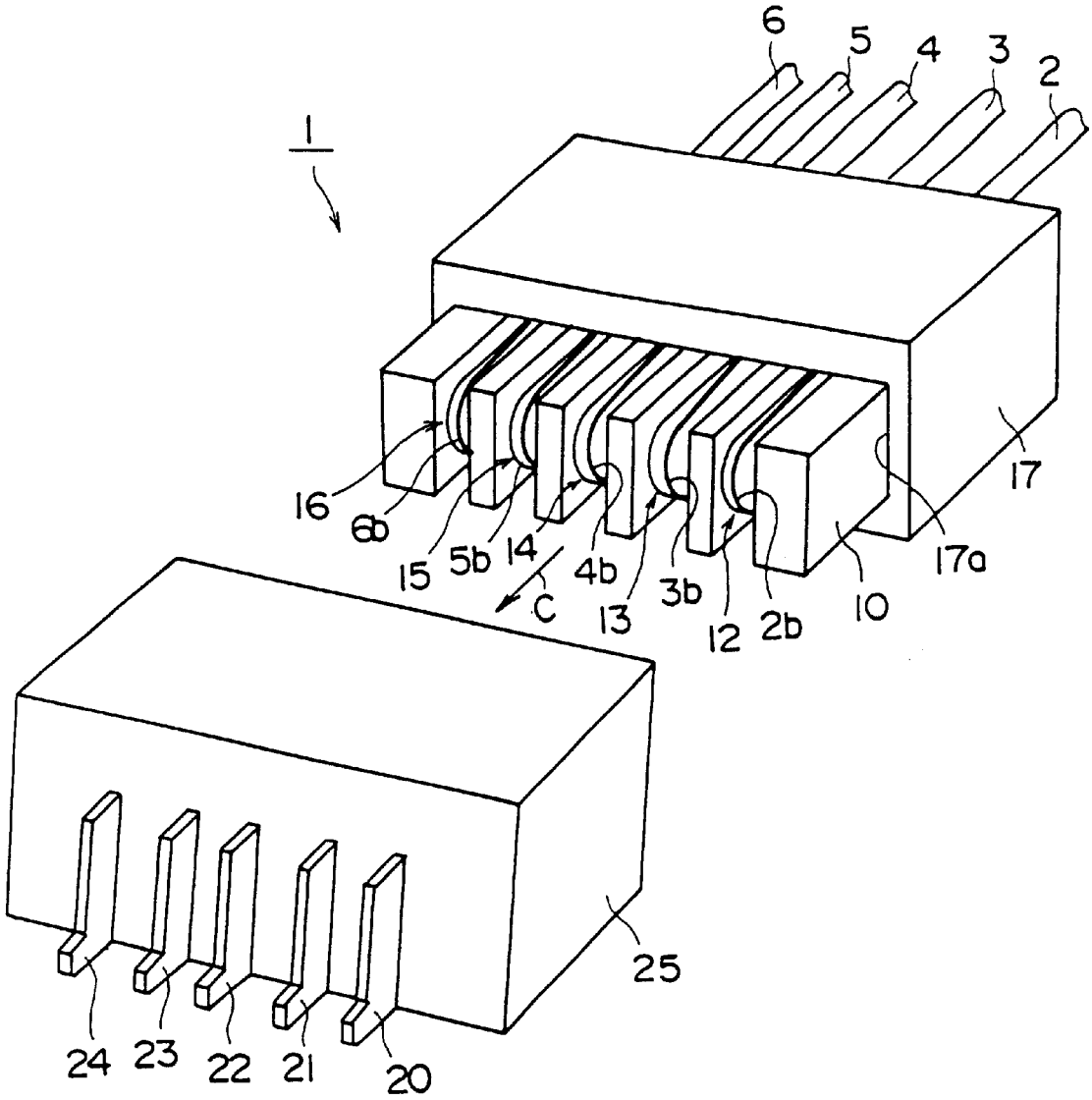
FIG. 5 is a perspective view showing the installation of the cable holder in the receptacle.

As shown in FIG. 5, when the cable holder 10 is installed in the holder cover 17, the cable conductors 2*b*–6*b*, which are bent in U-shape along cable guide slots 12–16, are exposed through an opening 17*a* formed in the front of the holder cover 17; the exposed cable conductors 2*b*–6*b* themselves can then be used as male contacts constituting the electric connector 1.

The exposed cable conductors 2*b*–6*b*, arranged along the cable guide slots 12–16, are installed in a receptacle 25 having a plurality of female contacts 20–24 arranged for each of the corresponding cable conductors 2*b*–6*b*.

Figure 6:
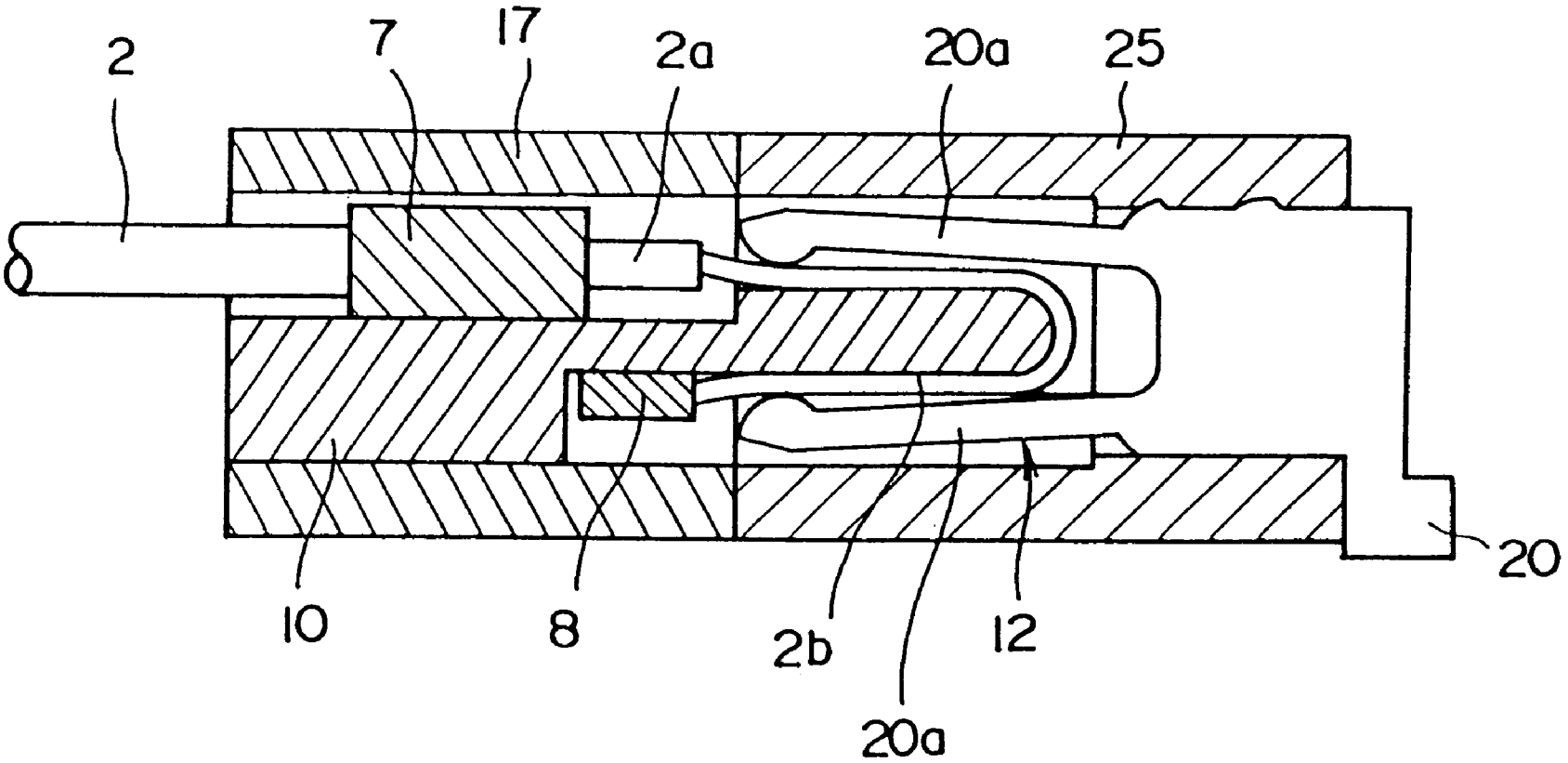
FIG. 6 is a schematic sectional view showing the state where the cable holder is installed in the receptacle.

FIG. 6 shows a sectional view of the principal elements of FIG. 5 and gives a representative explanation using the cable conductor 2*b* placed along the cable guide slot 12 and a female contact 20 corresponding to this cable conductor 2*b*. As shown in FIG. 6, the cable guide slot 12 is inserted in the tuning fork-shaped end 20*a* of the female contact 20 and at the same time, this tuning fork-shaped end 20*a* holds the cable conductor 2*b* which is placed in the cable guide slot 12, between its upper and lower surfaces. The cable conductor 2*b* and the corresponding female contact 20 are thereby placed in contact and an electrical connection is formed therebetween.

Each of the other cable conductors 3*b*–6*b* is also in contact with the corresponding female contact 21–24 and electrical connections are formed therebetween at the same time.

Moreover, the foregoing embodiment uses a non-conductive cable aligning member 7 to align the end portions 2*a*–6*a* of a plurality of cables 2–6 in a flat row at a prescribed interval, and a non-conductive laminate 8 to align the end portions of the cable conductors 2*b*–6*b* extending from the end portions 2*a*–6*a* in a row at a prescribed interval. However, the present invention is not limited by the foregoing embodiment and the cable aligning member 7 and laminate 8, for aligning the cable conductors 2*b*–6*b* in a row at a prescribed interval, are not necessarily required and may be eliminated, because the cable conductors 2*b*–6*b* are aligned at a prescribed interval and in a row by the cable guide slots 12–16 which are bent in U-shape.

Also, in the foregoing embodiment, the holder cover 17 is used as a clamp for the cable aligning member 7 and laminate 8, specifically, the means for holding the U-shaped bend of the cable conductors 2*b*–6*b*. However, this holder cover 17 is not necessarily required for installing the cable holder 10 in the receptacle 25. A cable holder 10, without a holder cover 17 and wherein cable conductors 2*b*–6*b* are placed, may be installed directly in the receptacle 25.

Moreover, in the foregoing embodiment, the cable holder 10, holding the cable conductors 2*b*–6*b* at a prescribed interval, is used as the plug having a plurality of male contacts and is installed in the receptacle 25. However, the present invention is not limited to the foregoing embodiment. Alternatively, the cable holder 10 for holding the cable conductors 2*b*–6*b* at a prescribed interval, may be installed in the plug having male contacts, and the plug wherein the cable holder 10 is installed may be installed in a receptacle having female contacts.

Figure 7:
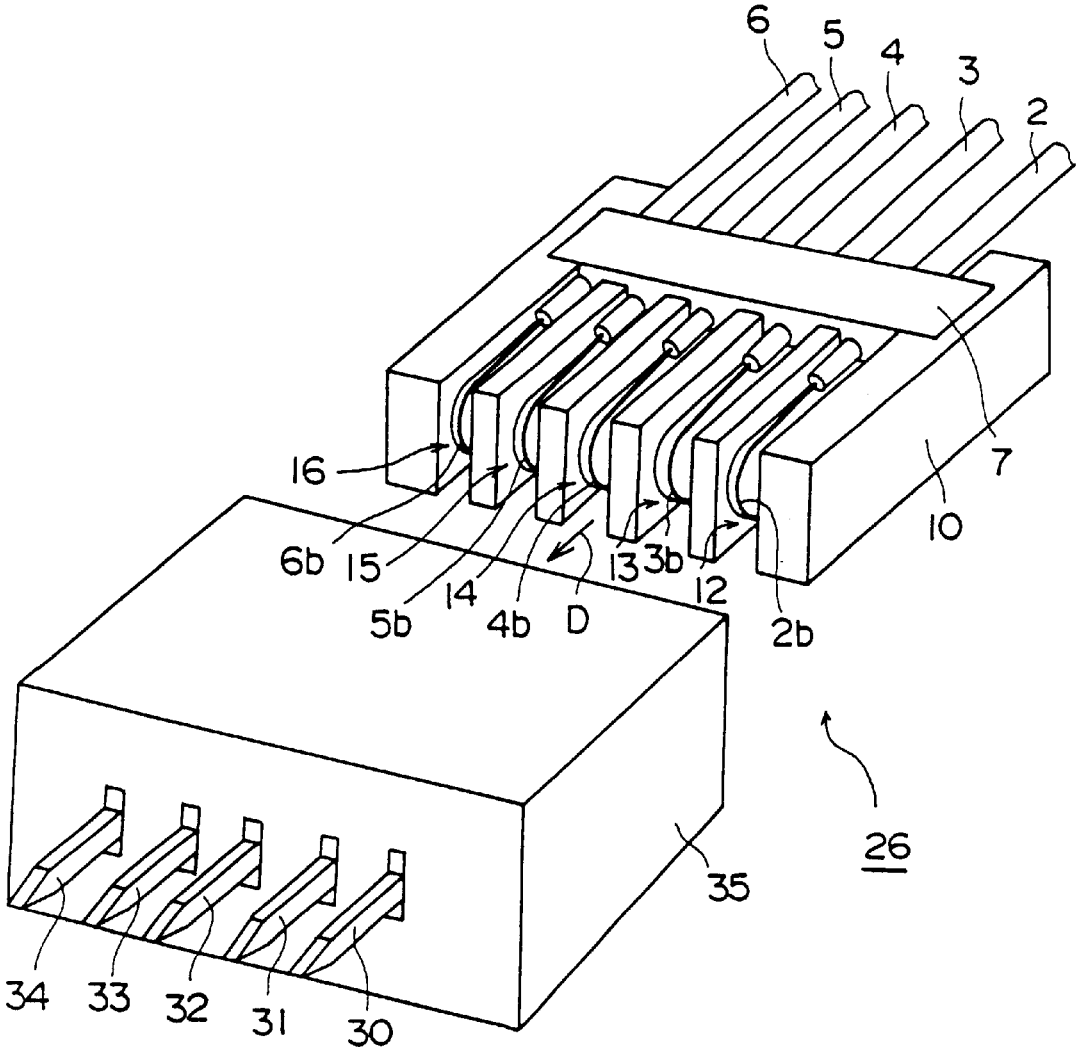
FIG. 7 is a perspective view showing the installation of the cable holder in the plug.

FIG. 7, wherein the same portions as in FIG. 1 are shown with the same symbols, is a perspective view showing an electric connector 26, according to a second embodiment of the first invention, wherein the cable holder 10 which holds cable conductors 2*b*–6*b*, is installed in a plug 35 having corresponding male contacts 30–34.

Figure 8:
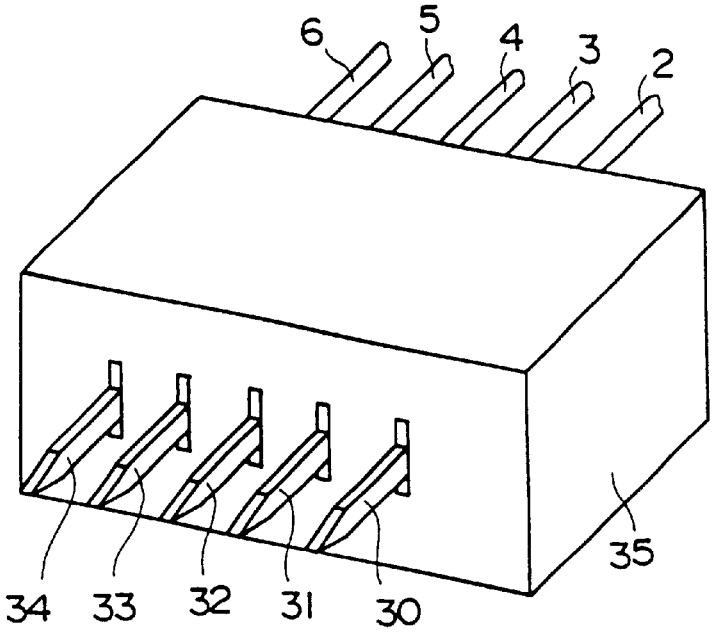
FIG. 8 is a schematic perspective view showing the state where the cable holder is installed in the plug.

In the electric connector 26 in the second embodiment of the first invention, when the cable holder 10, having the cable conductors 2*b*–6*b* exposed along the cable guide slot 12–16, is inserted in the plug 35, having male contacts 30–34 corresponding to each of the cable conductors 2*b*–6*b*, in a direction as shown with the arrow D in FIG. 7, the cable holder 10 is installed in the plug 35 and thereby supported and its position set as shown in FIG. 8.

Figure 9:
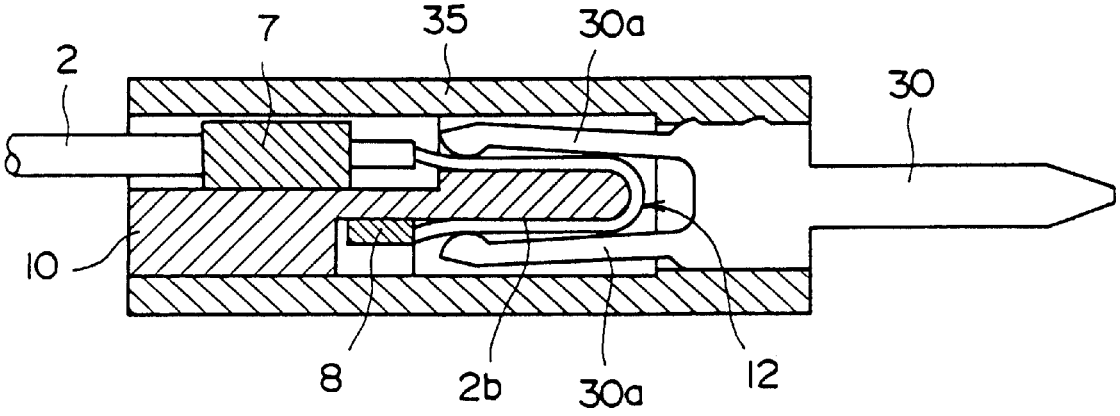
FIG. 9 is a schematic sectional view showing the state where the cable holder is installed in the plug.

FIG. 9 shows a sectional view of the principal elements of FIG. 8 and gives a representative explanation using the cable conductor 2*b* placed along the cable guide slot 12 and a male contact 30 corresponding to this cable conductor 2*b*. As shown in FIG. 9, the cable guide slot 12 is inserted in the tuning fork-shaped back end 30*a* of the male contact 30 and at the same time, this tuning fork-shaped back end 30*a* holds the cable conductor 2*b*, placed in the cable guide slot 12, between its upper and lower surfaces. The cable conductor 2*b* and the corresponding male contact 30 are thereby placed in contact and an electrical connection is formed therebetween. The other cable conductors 3*b*–6*b* are also in contact with the corresponding male contacts 31–34 and at the same time, electrical connections are formed therebetween.

Figure 10:
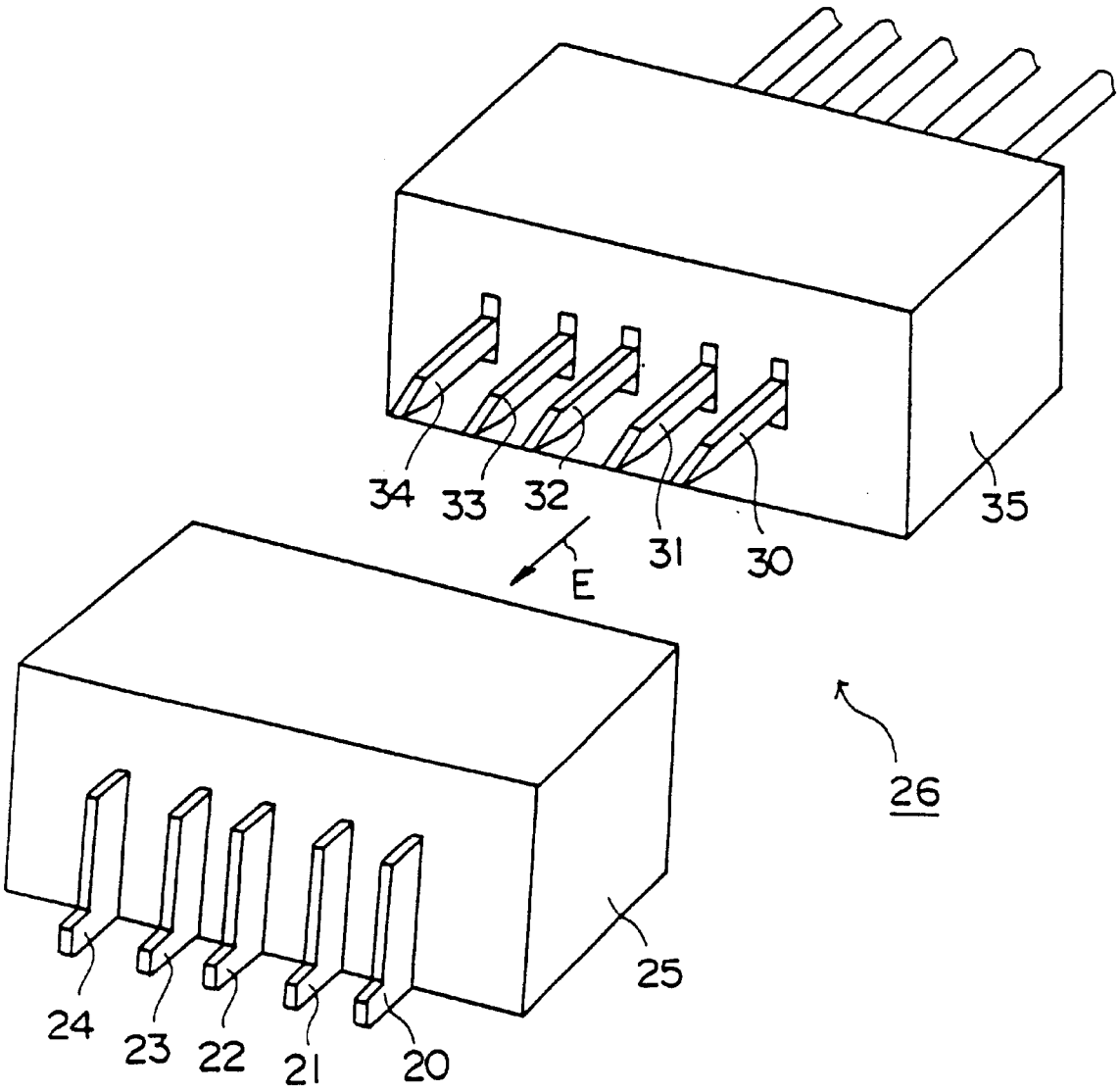
FIG. 10 is a perspective view showing the installation of the plug in the receptacle.

Next, as shown by the arrow E in FIG. 10, the plug 35, wherein is installed the cable holder 10 shown in FIG. 8, is fitted in the receptacle 25, wherein are disposed the female contacts 20–24 corresponding to the male contacts 30–34. Whereupon, as shown by the sectional view of principal elements in FIG. 11, which gives a representative explanation using the female contact 20 corresponding to the male contact 30, the male contact 30 is inserted in the tuning fork-shaped end 20*a* of the female contact 20 and at the same time the tuning fork-shaped end 20*a* captures the male contact 30. The male contact 30 and corresponding female contact 20 are thereby brought into contact and an electrical connection is formed therebetween.

The other male contacts 31–34 are also in contact with the corresponding female contacts 21–24 and at the same time, electrical connections are formed therebetween.

Figure 11:
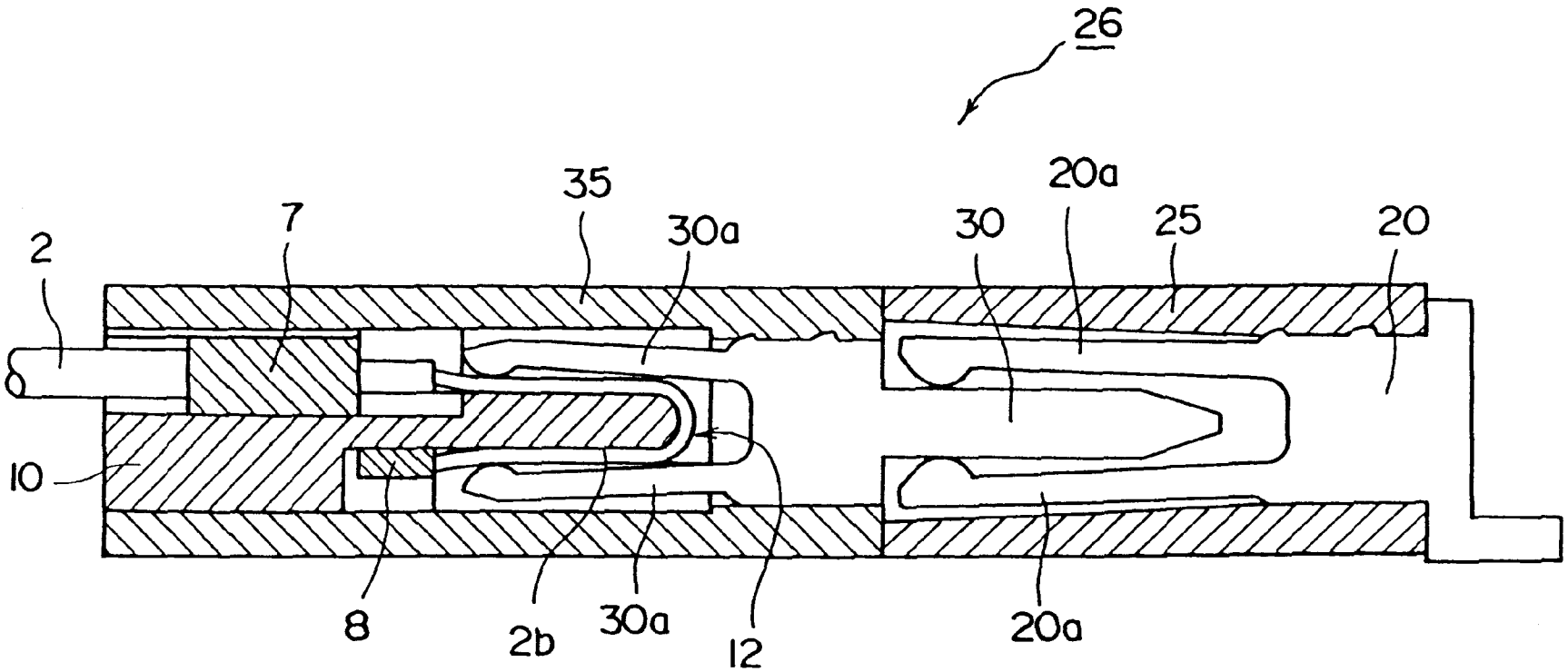
FIG. 11 is a schematic sectional view showing the state where the plug is installed in the receptacle.

Consequently, as shown in FIG. 11, the cable conductor 2*b* forms an electrical connection with the female contact 20 of the receptacle 25 by means of the male contact 30.

Likewise, the cable conductor 3*b* forms an electrical connection with the female contact 21 of the receptacle 25 by means of the male contact 31; the cable conductor 4*b* forms an electrical connection with the female contact 22 of the receptacle 25 by means of the male contact 32; the cable conductor 5*b* forms an electrical connection with the female contact 23 of the receptacle 25 by means of the male contact 33; and the cable conductor 6*b* forms an electrical connection with the female contact 24 of the receptacle 25 by means of the male contact 34.

Moreover, the first and second embodiments were explained in detail for the use of the cables 2–6 wherein extra-fine conductors (cable conductors) were disposed in an insulator. However, the present invention is not limited to the foregoing embodiments and is also applicable to a bundle of a plurality of extra-fine coaxial cables.

Figure 12:
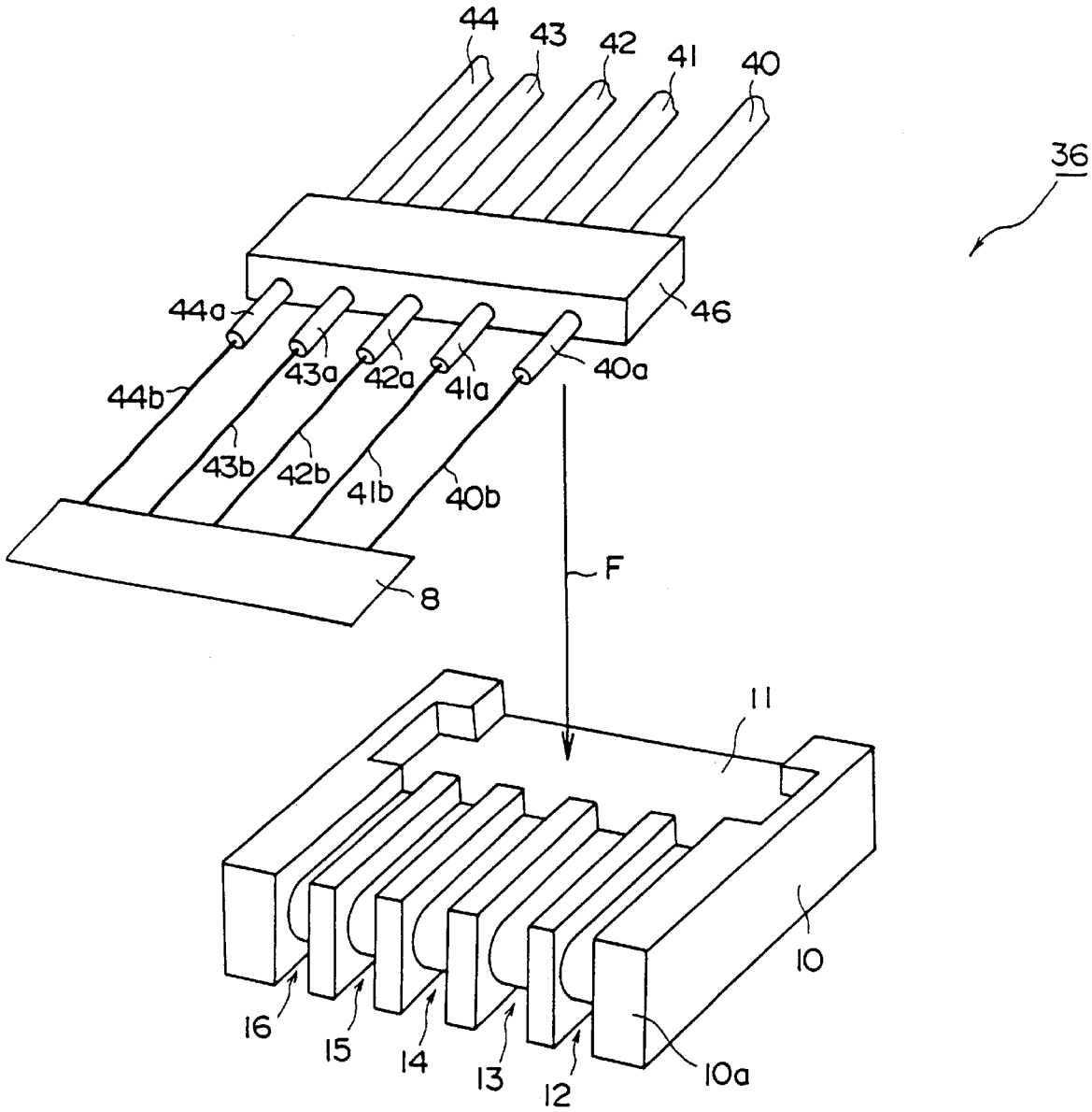
FIG. 12 is a perspective view showing the assembly showing a cable holder where coaxial cable is used.

FIG. 12, wherein the same portions as in FIG. 1 are shown with the same symbols, is a schematic perspective view showing the principal elements of the electric connector 36, according to a third embodiment of the first invention, wherein the cable is a plurality of extra-fine coaxial cables which are bundled.

In the electric connector 36 in this embodiment, the outer conductors of the extra-fine coaxial cables 40–44 are passed through a cable aligning member 46, to align the end portions 40*a*–44*a* of the coaxial cables 40–44 in a flat row and at a prescribed interval, and the outer conductors of the coaxial cables 40–44 are short circuited to each other by the conductive cable aligning member 46.

Meanwhile, end portions of the inner conductors 40*b*–44*b* extending from the inner insulators (i.e., the end portions

40*a*–44*a* of the coaxial cables 40–44) are joined by the non-conductive laminate 8, for aligning the end portions in a row at a prescribed interval.

Figure 13:
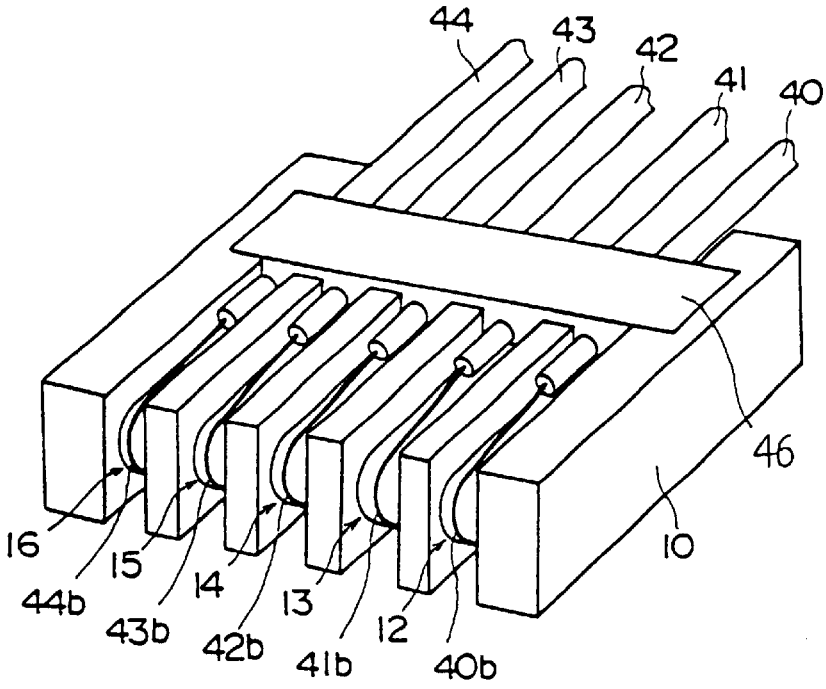
FIG. 13 is a schematic perspective view showing the cable holder after assembly is complete.
Figure 14:
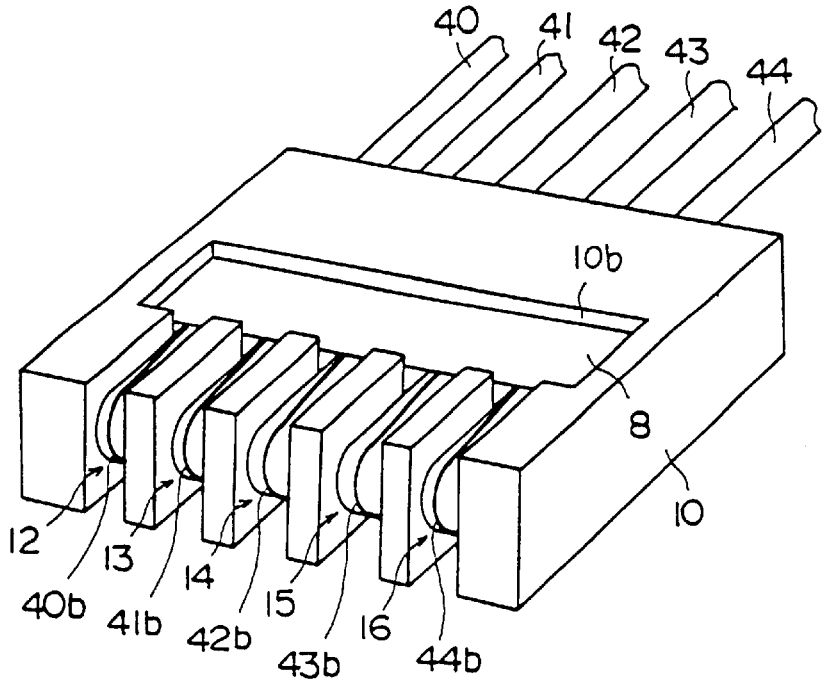
FIG. 14 is a schematic perspective view showing the cable holder after assembly is complete.

Referring to FIG. 12, by moving the cable aligning member 46 in which the coaxial cables are arranged as above described in a direction shown by the arrow F, it is housed in the depressed portion 11 of the cable holder 10 with its position being set. Afterwards, the inner conductors 40*b*–44*b* of the coaxial cables 40–44 are bent in U-shape along the corresponding plurality of cable guide slot 12–16, as shown in FIG. 13 and in FIG. 14 which shows the rear side.

Then, the cable holder 10, wherein are disposed the coaxial cables 40–44 discussed above, can be installed in the receptacle 25 by means of the holder cover 17 as shown in FIGS. 5 and 6. Alternatively, the cable holder 10, wherein are disposed the coaxial cables 40–44, can be installed directly in the plug 35 as shown in FIGS. 8 and 9 and then the plug 35, wherein the cable holder 10 is installed, can be installed in the receptacle 25 as shown in FIGS. 10 and 11.

Figure 15:
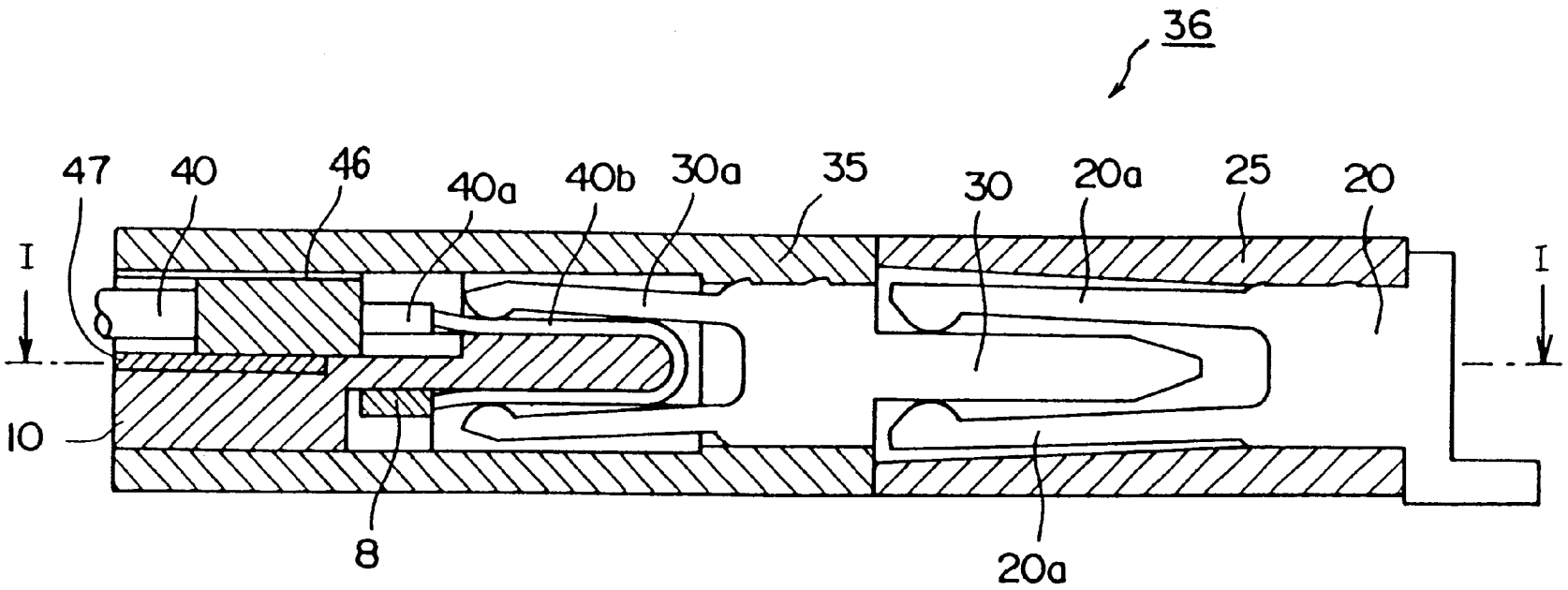
FIG. 15 is a schematic sectional view showing the state where a plug, using a coaxial cable, is installed in the receptacle.
Figure 16:
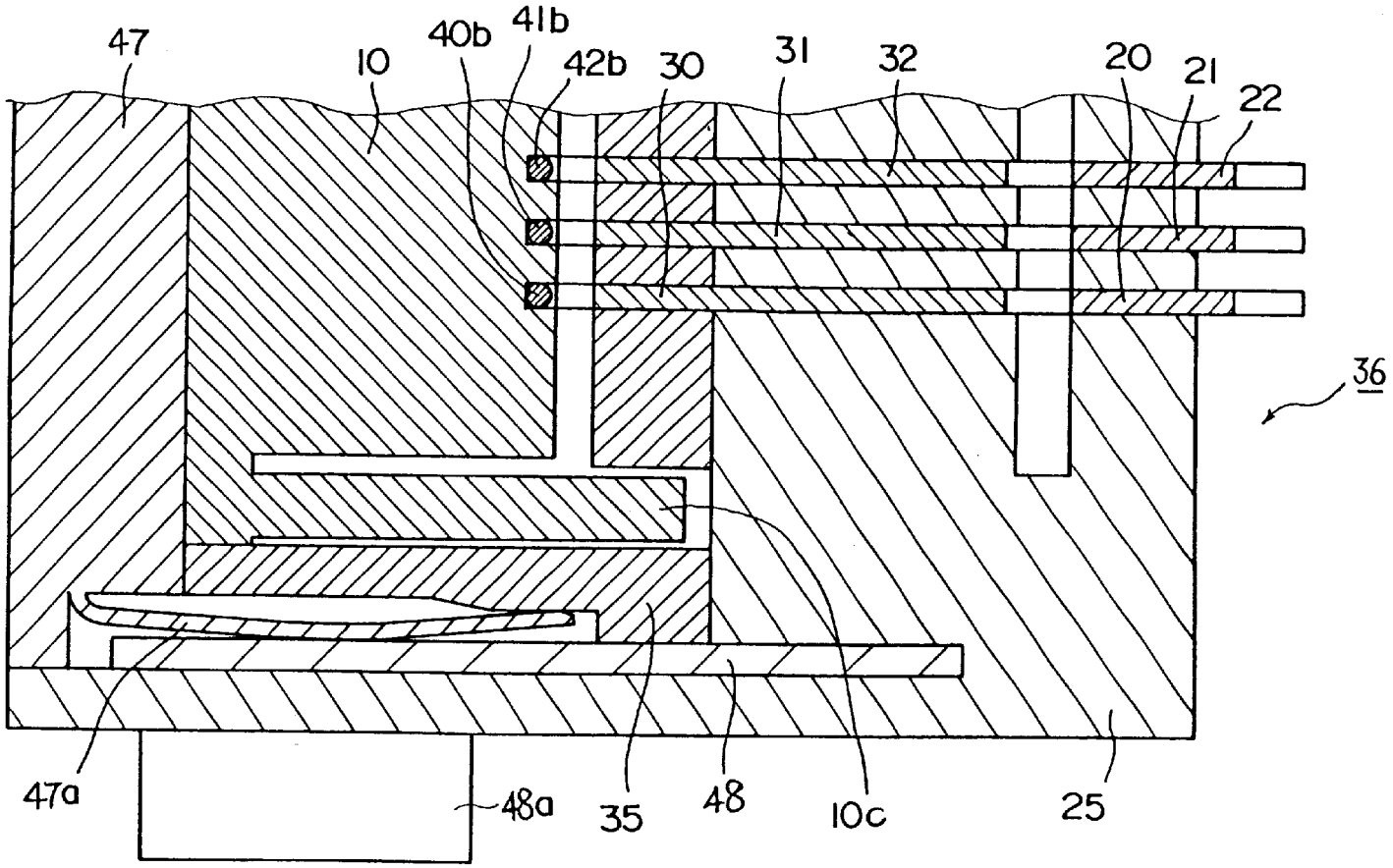
FIG. 16 is a schematic cross section taken along line XVI—XVI in FIG. 15.

In the electric connector wherein the coaxial cables 40–44 are installed in the cable holder 10, the outer conductors of the coaxial cables must be connected to a common ground. In that case, as shown in the electric connector 36 in FIG. 15, wherein the same portions as in FIG. 11 are shown with the same symbols, a grounding plate 47 is positioned on the lower surface of the conductive cable aligning member 46 so as to be in electrically contact with the cable aligning member 46. Furthermore, as shown in FIG. 16, which is a sectional view of the principal elements taken along line XVI—XVI in FIG. 15, a part 47*a* of the grounding plate 47 is exposed to the side of the plug 35 and when that part 47*a* of the grounding plate 47 is inserted between the plug 35 and receptacle 25, that part 47*a* is put in contact with the terminal 48 placed on the side toward the receptacle 25. A part 48*a* of the terminal 48 is exposed on the outside of the receptacle 25 to use the part 48*a* as a ground terminal.

The symbol 10*c* in FIG. 16 shows a latch to support and set the position of the cable holder 10 in the plug 35.

Figure 17:
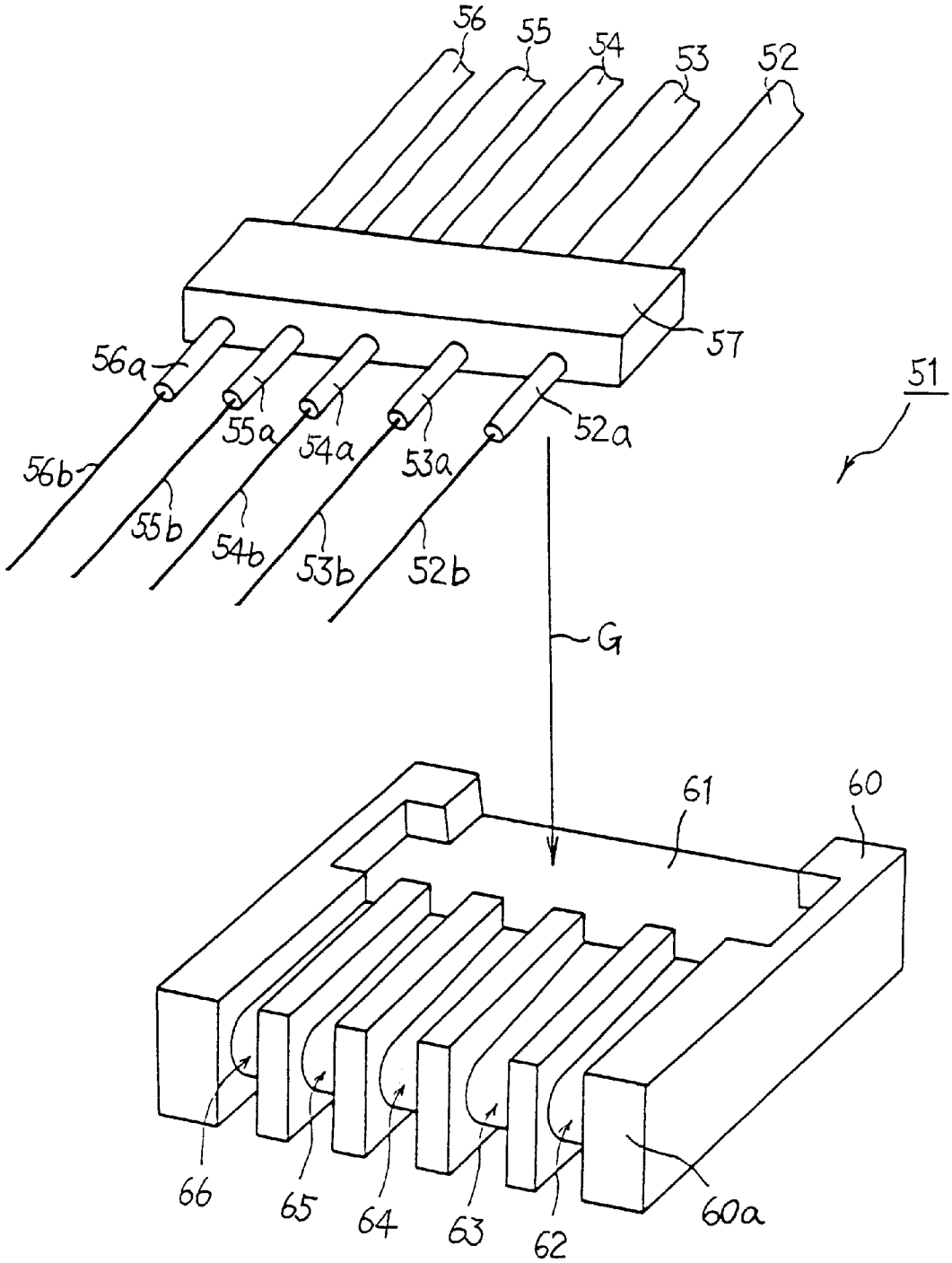
FIG. 17 is a perspective view showing the assembly showing a cable holder of the connector according to another embodiment of the present invention.

FIG. 17 is a schematic perspective view to show the principal elements of an electric connector 51 showing a fourth embodiment of the first invention. The electric connector 51 showing the fourth embodiment of the first invention is provided a non-conductive cable aligning member 57, to align the end portions 52*a*–56*a* of a plurality of extra-fine cables 52–56 in a flat row and at a prescribed interval. The cable conductors 52*b*–56*b* extend from the end portions (inner insulator) 52*a*–56*a* of the cables 52–56 supported by the cable aligning member 57.

A cable holder 60 to align the cable conductors 52*b*–56*b* of the extra-fine cables 52–56 in a row at a prescribed interval, is formed of an insulator made from synthetic resin such as plastic. A depressed portion 61, for housing and setting the position of the cable aligning member 57, is formed on the upper surface thereof.

A plurality of cable guide slots 62–66 are formed on this cable holder 60, facing the end 60*a* of the cable holder 60, and adjacent to the aforementioned depressed portion 61. These cable guide slots 62–66 have U-shaped cross section and are formed at a prescribed interval; and these cable guide slots 62–66 bend the cable conductors 52*b*–56*b*, extending from the cable aligning member 57, in U-shape toward the front end without causing them to contact each other.

Figure 18:
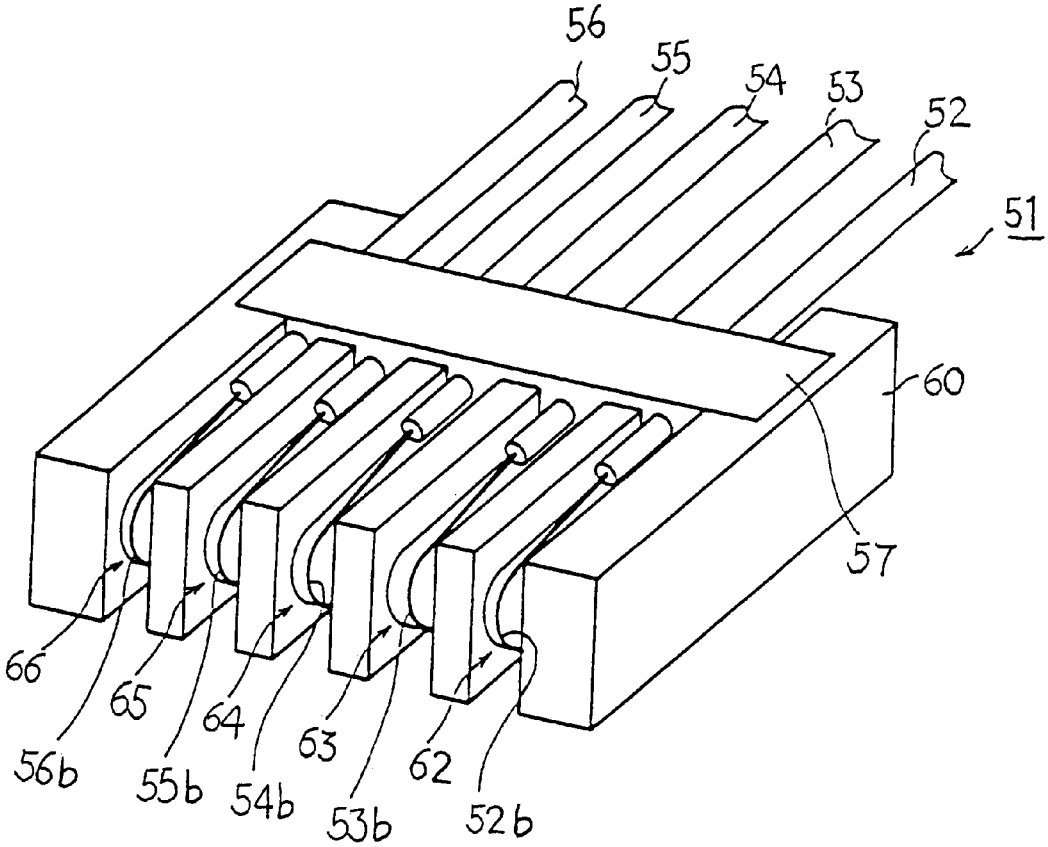
FIG. 18 is a schematic perspective view showing the cable holder after assembly is complete.

With such a cable holder 60, the cable aligning member 57 is held in and its position set by the depressed portion 61 as shown by the arrow G in FIG. 17. Afterwards, the cable conductors 52*b*–56*b* are bent in U-shape in the direction of the corresponding cable guide slots 62–66. At this point, the cable conductors 52*b*–56*b* of the extra-fine cables 52–56 are bent in U-shape and aligned in a row with the plurality of corresponding cable guide slots 62–66, as shown in the perspective view in FIG. 18. The cable conductors 52*b*–56*b* are thereby exposed.

Consequently, the cable conductors 52*b*–56*b* themselves, which are bent in U-shape and exposed with the cable holder 60, can be used as the male contact constituting the electric connector 51.

Figure 19:
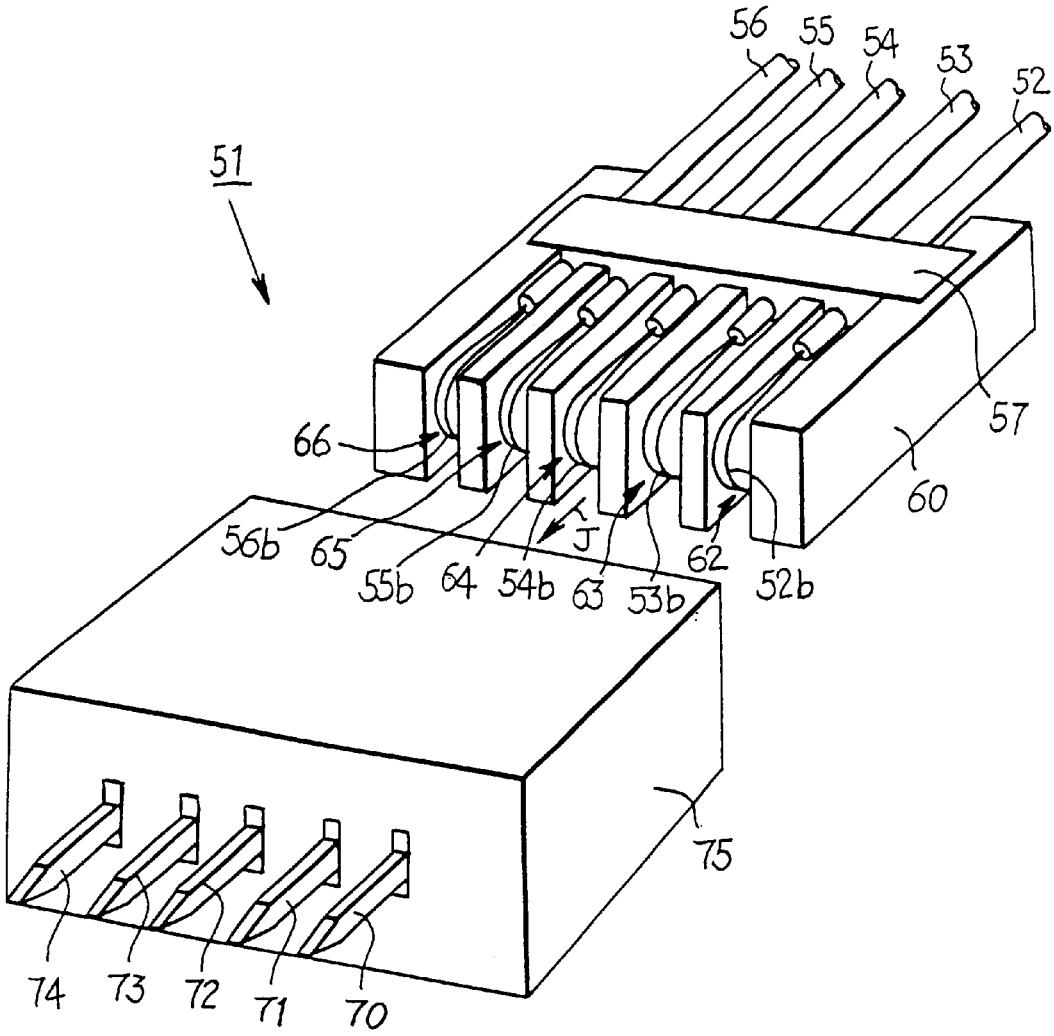
FIG. 19 is a schematic perspective view showing the receptacle and cable holder.

Meanwhile, as shown by the arrow J in FIG. 19, the cable holder 60, having the cable conductors 52*b*–56*b* exposed along the cable guide slots 62–66, is installed in the receptacle 75, having female contacts 70–74 positioned for each of the corresponding cable conductors 52*b*–56*b*. At this point, the cable conductors 52*b*–56*b* and the corresponding female contacts 70–74 contact each other and an electrical connection is formed therebetween.

Next, the female contacts 70–74, arranged in the receptacle 75, are explained in detail. As the female contacts 70–74 have the same structure, only the female contact 70 and the cable conductor 52*b* connected thereto are explained in detail.

Figure 20:
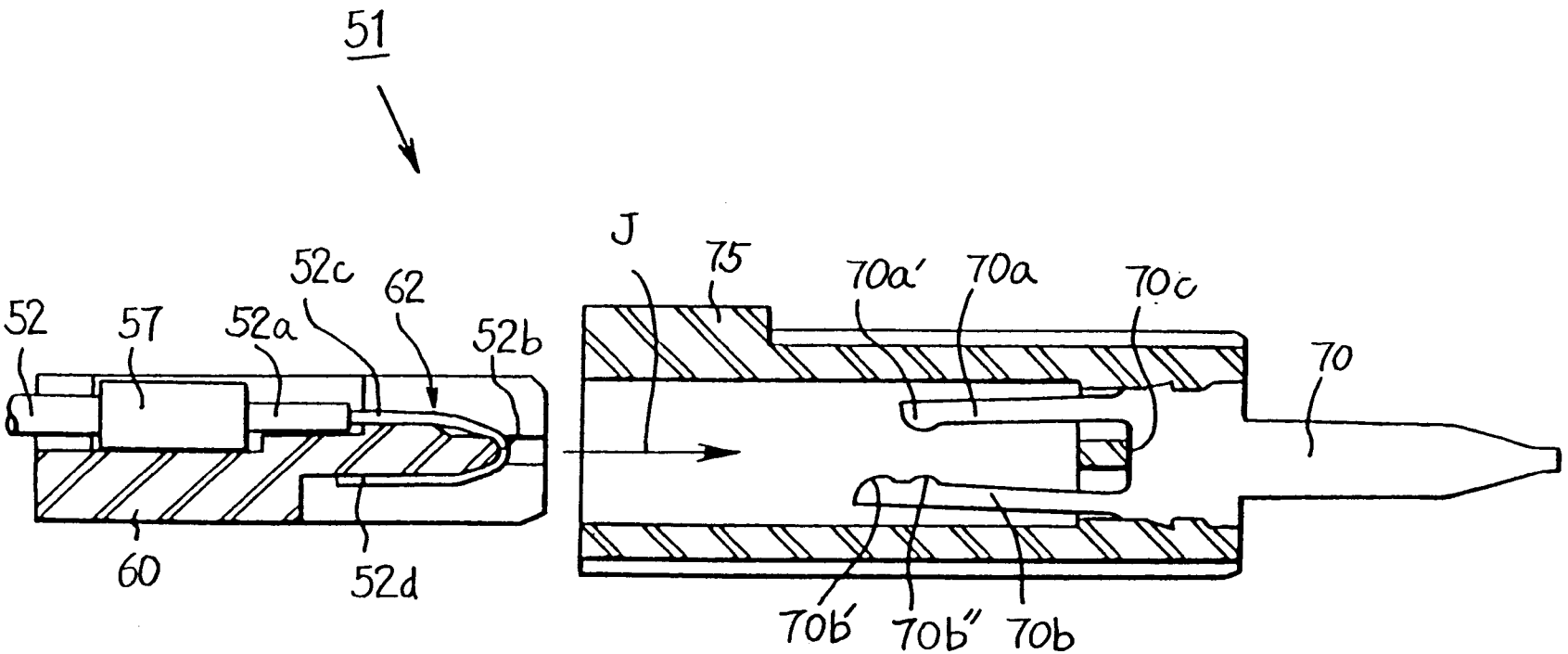
FIG. 20 is a schematic sectional view showing the installation of cable holder in the receptacle.

FIG. 20 is a sectional view of the principal elements in FIG. 19 and, in particular, shows the structure of the connection between the female contact 70 and the corresponding cable conductor 52*b*. Portions identical to those in FIG. 19 are shown with the same symbols in FIG. 20.

As shown in FIG. 20, the female contact 70 is encased in the receptacle 75, comprising a housing, and is formed as follows. The end of the female contact 70 forks above and below to form a pair of contact portions 70*a*, 70*b*. In the so-called tuning fork-shaped female contact, the length of one contact portion 70*b*, which is in the lower position, is longer than the other contact portion 70*a* which is in the upper position.

This longer contact portion 70*b* is constituted of a second contact 70*b*′ formed on the end and a third contact 70*b*″ positioned more toward the base end 70*c* of the female contact 70 than the second contact 70*b*′. This third contact 70*b*″ is formed at a position opposite from a first contact 70*a*′ formed on the end of the other contact portion 70*a*, which is positioned above the contact portion 70*b*.

The pair of contact portions 70*a*, 70*b* of the female contact 70 are positioned as follows. One contact portion 70*a* is located at a position opposite to the base end 52*c* of the cable conductor 52*b* located in the cable guide slot 62 of the cable holder 60; the other contact portion 70*b* is located at a position opposite to the end 52*d* of the cable conductor 52*b*.

Figure 21:
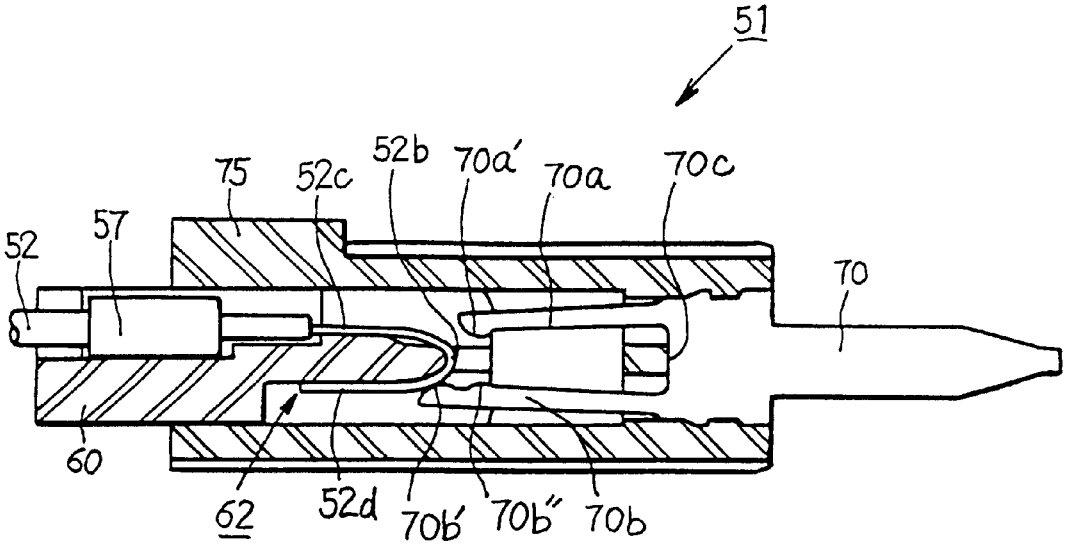
FIG. 21 is a schematic sectional view showing the installation of the cable holder in the receptacle.

The cable holder 60 is inserted in the receptacle 75 having a female contact 70 with this type of structure, as shown by the arrow J in FIG. 20. As shown in FIG. 21, firstly, the second contact 70*b*′ in the longer contact portion 70*b*, is in sliding contact with the end 52*d* of the corresponding cable conductor 52*b*. The cable conductor 52*b* is thereby pulled from the base end 52*c* to the side toward the end 52*d* as it is inserted.

In this way, during the insertion of the cable holder 60, the second contact 70*b*′ of the longer contact portion 70*b* is first in sliding contact with the end 52*d* of the cable conductor 52*b*; while being inserted, the cable conductor 52*b* is drawn toward the end 52*d* from the base end 52*c* thereof. This can prevent the end 52*d*, which is the free end of the cable conductor 52*b*, from slackening or rising free inside the cable guide slot 62.

Figure 22:
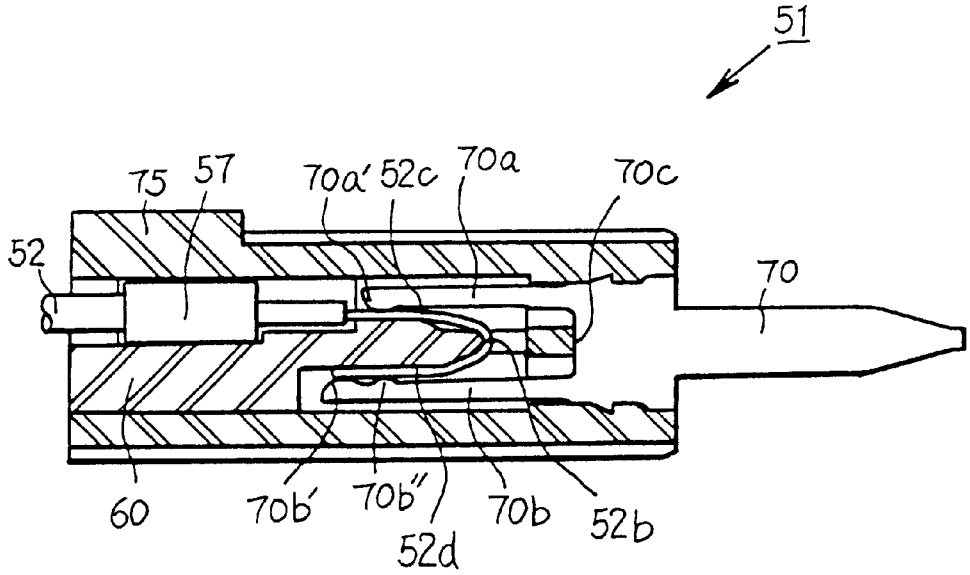
FIG. 22 is a schematic sectional view showing the state where the cable holder is installed in the receptacle.

As the cable holder 60 is inserted further inside the receptacle 75 from the position shown in FIG. 21, the third contact 70*b*″ in the contact portion 70*b*, is in sliding contact with the end 52*d* of the corresponding cable conductor 52*b* as shown in FIG. 22. At the same time, the contact of the second contact 70*b*′, which is on the end, with the end 52*d* of the cable conductor 52*b* is released. The first contact 70*a*′ of the shorter contact portion 70*a* contacts the end 52*c* of the cable conductor 52*b* at that time; and the cable conductor 52*b* is firmly held by the third contact 70*b*″ of the contact portion 70*b* and the first contact 70*a*′ of the other contact portion 70*a*. An electrical connection is formed between the cable conductor 52*b* and the female contact 70.

As shown in FIG. 22, the cable conductor 52*b* is held by the third contact 70*b*″ formed on one contact portion 70*b* and the first contact 70*a*′ formed on the other contact portion 70*a*; the contact of the second contact 70*b*′, on the contact portion 70*b*, with the end 52*d* of the cable conduct 52*b* is clamped. At this point, the cable conductor 52*b* becomes held by equal pressures from the third contact 70*b*″ and the first contact 70*a*′, which are equidistant from the base end 70*c* of the female contact 70.

Compared to the case where the cable conductor 52*b* might be held with different pressures by the first contact 70*a*′ and the second contact 70*b*′ which are at different distances from the base end 70*c* of the female contact 70, the foregoing arrangement reduces the risk of deforming the receptacle 70 itself, which is the housing, as much as possible. For this reason, the deformation of the receptacle 75 is prevented as much as possible even if panels are made thin, in order to thin the receptacle 75, and the mechanical strength thereof is reduced.

Consideration of the foregoing point is not necessary when the housing of the receptacle 75 is formed with materials or a structure with a strong mechanical strength. The cable conductor 52*b* may be held by the third contact 70*b*″ and the first contact 70*a*′, which are at equal distances from the base end 70*c* of the female contact 70; or it may also be held by the first contact 70*a*′ and the second contact 70*b*′ which are at different distances from the base end 70*c* of the female contact 70.

In the electric connector according to the first invention as explained above, since cable conductors are disposed along the cable guide slots in a cable holder having a plurality of cable guide slots formed at a prescribed interval and bent in U-shape, they are thereby bent in U-shape. The cable conductors thus bent in U-shape can be used as the electric connector plug. Therefore, it is possible to connect the wires all at once, without the heretofore required wire bonding work with pressure-bonding or soldering processes for the cable conductors and contacts. For this reason, the wire bonding work of the electric connector can be performed very simply and incorrect wiring prevented as well.

Also, in the electric connector according to the first invention, there are no pressure-bonded or soldered portions bonding the cable conductors and contacts, as in conventional electric connectors. The interval between the cable conductors corresponding to the contacts can therefore be made even smaller and for this reason, the size of the electric connector can be further reduced.

Furthermore, in the fourth embodiment of the electric connector according to the first invention, female contacts, in the shape of tuning forks with one contact portion to contact the end of the cable conductor being longer than the another contact portion to contact the base side of the cable conductor, are disposed inside the receptacle in which is inserted the cable holder having cable conductors. With this configuration, the free ends of the cable conductors are prevented from such deformation as slackening or rising up within the cable guide slots. Stable electrical connections are thereby formed between the cable conductors and corresponding female contacts. Therefore, an electric connector with high reliability can be provided.

Next, the embodiments of an electric connector according to the second invention, specifically an electric connector with a shield cover, are explained in details.

Figure 23:
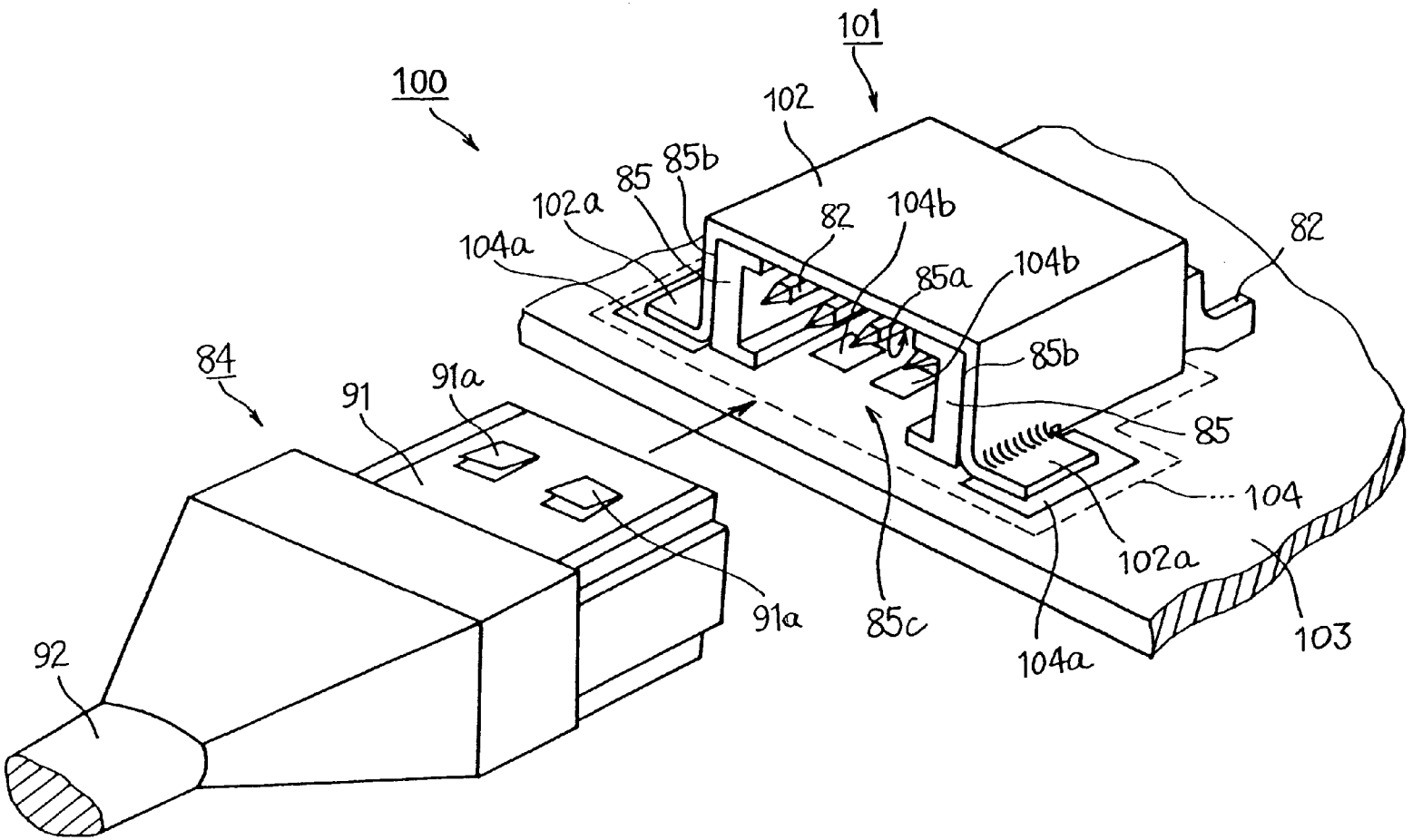
FIG. 23 is a schematic perspective view of the electric connector with shield cover according to the present invention.
Figure 24:
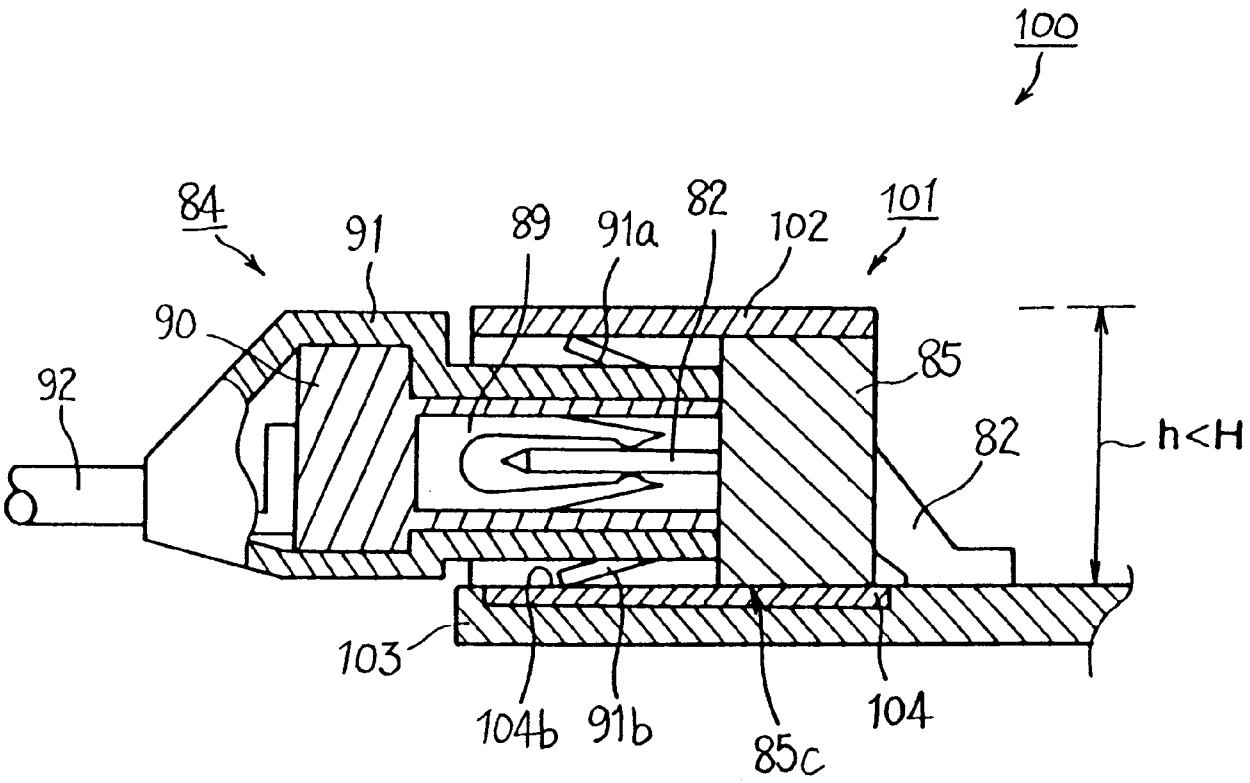
FIG. 24 is a schematic sectional view of the electric connector with shield cover according to the present invention.
Figure 25:
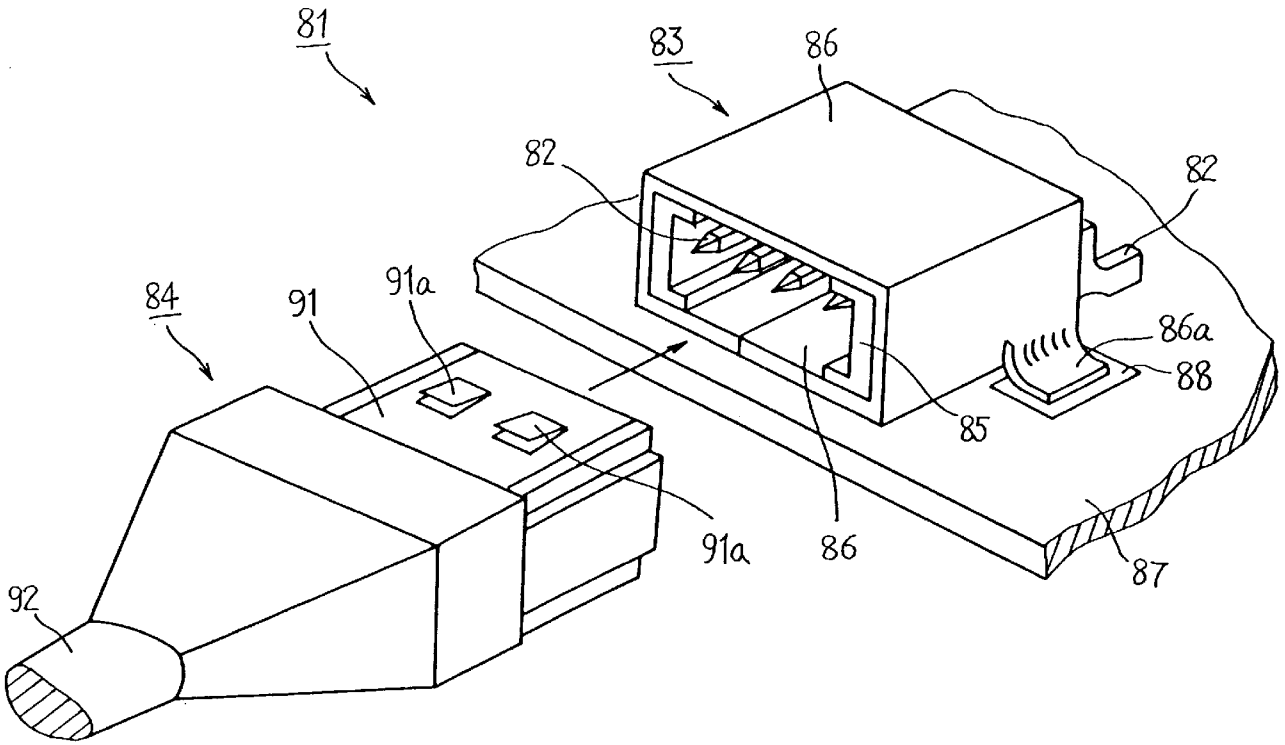
FIG. 25 PRIOR ART
FIG. 25 is a schematic perspective view of a conventional electric connector with shield cover.
Figure 26:
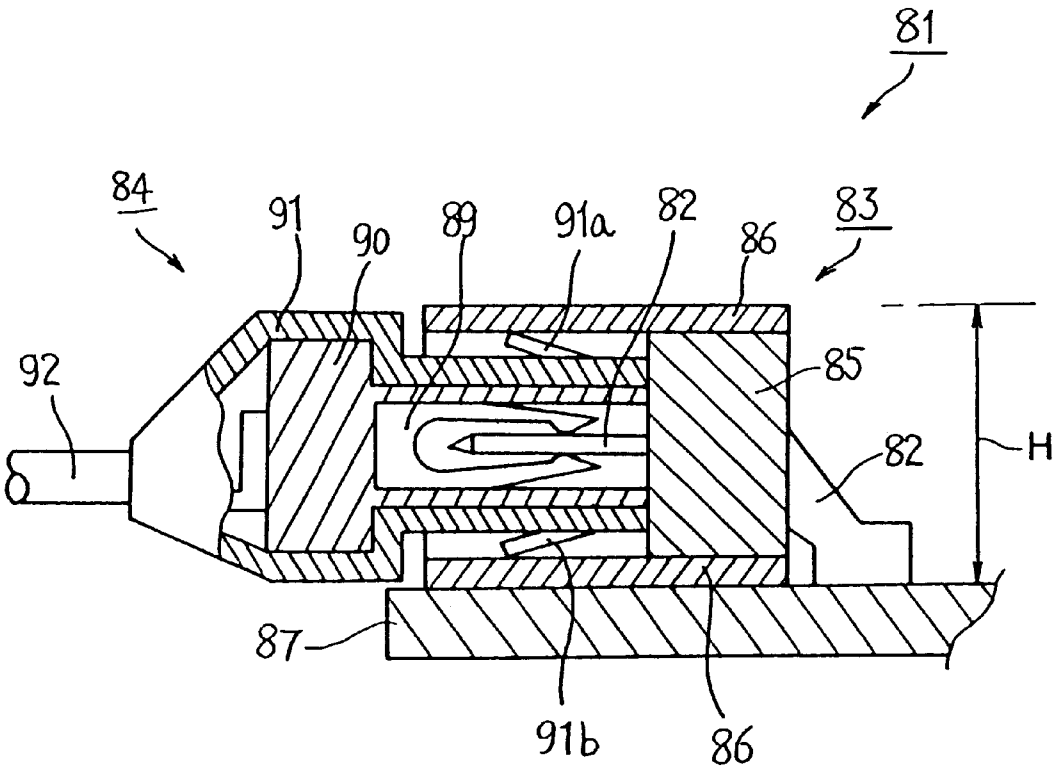
FIG. 26 PRIOR ART
FIG. 26 is a schematic sectional view of a conventional electric connector with shield cover.

FIGS. 23 and 24 are respectively a perspective view and a sectional view of an electric connector 100 with shield cover (referred to below as "electric connector") according to the second invention. Portions identical to portions in FIGS. 25 and 26 are shown with the same symbols.

In the receptacle 101 of the electric connector 100, a receptacle shield cover 102 covering a receptacle housing 85 is formed so as to have a cross section shaped like a square missing a bottom side, thereby giving it a structure for covering only the upper surface 85*a* of the receptacle housing 85 and both sides 85*b*.

A shielding conductive pattern, in a form covering at least the entire bottom surface 85*c* of the receptacle housing 85, is formed at the position of a printed circuit board 103 where the receptacle 101 is installed, specifically the position opposite the bottom surface of the receptacle 101.

A part of the shielding conductive pattern 104, that is, a conductive pattern 104*a* which is in a form corresponding to the tongue piece 102*a*, is exposed at the position opposite to the aforementioned tongue piece 102*a* of the receptacle shield cover 102. Also exposed are conductive patterns 104*b* which are in a form corresponding to tongue pieces 91*b* at a position opposite to the pair of tongue pieces 91*b* formed on the lower surface of the plug shield cover 91 located in the receptacle housing 85.

The conductive pattern 104*a* and the tongue piece 102*a* of the receptacle shield cover 102 are affixed together by soldering so as to form an electrical connection to each other.

As shown in FIG. 24, a pair of tongue pieces 91*a*, formed on the upper surface of the plug shield cover 91, are in sliding contact with the receptacle shield cover 102 of the receptacle 101 when the plug 84 is installed and ensure electrical conductivity with the receptacle shield cover 102.

Consequently, the pair of tongue pieces 91*a* formed on the upper surface of the plug shield cover 91 is electrically connected to the conductive pattern 104*a* by means of the tongue piece 102 of the plug shield cover 91, and the pair of tongue pieces 91*b* formed on the lower surface is electrically connected to the conductive pattern 104*b*. This conductive pattern 104 is connected to a ground, not shown in the drawings.

With the electric connector 100, the tongue pieces 91*a* and 91*b* formed on the plug shield cover 91 of the plug 84 are caused to have an electrical connection with the conductive pattern 104, as shown in the sectional view in FIG. 24 of the state where the plug 84 is installed in the receptacle 101. At the same time, as shown in FIG. 23, the upper portion 85*a* and both sides 85*b* of the housing 85, are covered with the plug shield cover 102, with a sectional form of a square missing one side, and the bottom surface 85*c* of the receptacle side housing 85 is covered with the shielding conductive pattern 104. The outside of the receptacle side housing is thus entirely surrounded with shielding material. For this reason, the electric connector 100 is provided protective functions against damage from electromagnetic waves which are equivalent to those of a conventional electric connector with shield cover.

Also, with the electric connector 100, the receptacle 101 is constructed so that the upper surface 85*a* and both sides 85*b* are covered with the receptacle shield cover 102 and the bottom surface 85*c* is covered with the shielding conductive pattern 104, as shown in FIG. 23. Therefore, a shield cover is not needed on the bottom surface 85*c* of the receptacle side housing 85, resulting in that the height h of the receptacle 101 is made smaller than the height H of the conventional receptacle shown in FIGS. 25 and 26. It thereby becomes possible to give the receptacle 101 applied to a printed circuit board a thin form.

In this second invention, as described above, the receptacle shield cover covering the receptacle is formed with a cross section in the shape of a square missing one side and covers the upper surface and both sides of the receptacle with this receptacle shield cover; meanwhile, the bottom surface of the receptacle is covered by the shielding conductive pattern formed on the printed circuit board. For this reason, it becomes unnecessary to cover the entire receptacle with the receptacle shield cover unlike before and the height of the electric connector with shield cover can be reduced by that amount. Small electronic devices (portable. phones, for example) installed with such electric connectors with shield covers, can therefore be made thin and the miniaturization thereof achieved. In the case where the receptacle shield cover is bent and manufactured by mechanical means, such as a press, the final length of the receptacle shield cover becomes shorter by one side, meaning the base, compared to a conventional cover. The manufacture thereof is therefore easy and the electric connector with shield cover can therefore be provided at low cost.

The first and second inventions can be carried out in various other modes which do not fall outside the purview of the principal characteristics or spirit thereof. Accordingly, the foregoing embodiments are merely simple examples and should not be interpreted in a limited fashion. The scope of the present invention is shown by the claims and is not restricted in any way by the text of the specification. Furthermore, variations and alterations inherent to a scope equivalent to the scope of the patent application fall entirely within the scope of the present invention.

What is claimed is:

1. An electric connector comprising:

a plurality of separate cables;

a cable aligning member fixed onto the plurality of separate cables and specifically provided for collectively supporting exposed cable conductors of cable end portions of the plurality of separate cables, and for positioning and aligning the exposed cable conductors of cable end portions in a row at a prescribed interval;

a non-conductive cable holder having a depressed portion for supporting and setting the position of the cable aligning member, and a plurality of cable guide slots formed at a prescribed interval for bending the plurality of cable end portions extending from the cable aligning member including the exposed cable conductors in U-shape in a forward direction without causing them to contact each other; and a receptacle having a plurality of male contacts which are arranged such as to be inserted in each of the plurality of corresponding cable guide slots to hold each of the plurality of corresponding cable conductors positioned in the cable guide slots, thereby to form an electrical connection with the corresponding cable conductors.

2. The electric connector according to claim 1, wherein each of the plurality of female contacts is shaped in a tuning fork and has a pair of contact portions for holding corresponding ones of the cable conductors disposed in the cable guide slots, wherein the length of one of the contact portions contacting a fore and side of the cable conductors is longer than the length of another of the contact portions contacting a base side of the cable conductors.

3. The electric connector a according to claim 2, wherein said another contact portion is provided with a first contact at a fore end thereof, and said one contact portion is provided with a second contact at a fore end thereof and a third contact at a position opposite to the first contact provided at said another contact portion.

4. The electric connector according to claim 3, wherein the cable conductors are held by the first contact of said another contact portion and the second contact of said one contact portion, when the female contacts of the receptacle are inserted in the corresponding cable guide slot.

5. The electric connector according to claim 3, wherein the cable conductors are held by the first contact of said another contact portion and the third contact of said one contact portion, when the female contacts of the receptacle are inserted in the corresponding cable guide slot.

6. The electric connector according to claim 1, further comprising a holder cover installed on the cable holder, for maintaining the U-shaped bend of the cable conductors.

7. The electric connector according to claim 1, wherein the depressed portion of the non-conductive cable holder houses the cable aligning member.

8. An electric connector comprising:

a plurality of separate cables;

a cable aligning member fixed onto the plurality of separate cables and specifically adapted for collectively supporting exposed cable conductors of cable end portions of the plurality of separate cables, and for positioning and aligning the exposed cable conductors of cable end portions in a row at a prescribed interval;

a non-conductive cable holder having a depressed portion for supporting and setting the position of the cable aligning member, and a plurality of cable guide slots formed at a prescribed interval for bending the plurality of exposed cable conductors extending from the cable aligning member in U-shape in a forward direction without causing them to contact each other;

a plug having a plurality of female contacts which are arranged such as receive each of the plurality of corresponding cable guide slots to hold each of the plurality of corresponding cable conductors positioned in the cable guide slots, thereby to form an electrical connection with the corresponding cable conductors; and a receptacle having a plurality of female contacts into which the plurality of corresponding male contacts are inserted, thereby to form an electrical connection with corresponding male contacts.

9. The electric connector according to claim 8, further comprising a holder cover installed on the cable holder, for maintaining the U-shaped bend of the cable conductors.

10. The electric connector according to claim 8, wherein the cable aligning member includes a non-conductive laminate secured to distal ends the separate cables, which laminate is received in another depressed portion of the non-conductive cable holder.

11. The electric connector according to claim 8, wherein the depressed portion of the non-conductive cable holder houses the cable aligning member.

12. An electric connector comprising:

a plurality of separate coaxial cables;

a conductive cable aligning member fixed onto the plurality of separate coaxial cables and specifically provided for aligning exposed conductors of the plurality of separate coaxial cables in a row at a prescribed interval;

a non-conductive cable holder having a depressed portion for supporting and setting the position of the cable aligning member, and a plurality of cable guide slots formed at a prescribed interval for bending the exposed conductors of conductors of the plurality of coaxial cables, extending from the cable aligning member, in U-shape in a forward direction without causing them to contact each other;

a plug having a plurality of male contacts which are arranged such as to be inserted in each of the plurality of corresponding cable guide slots to hold each of the plurality of corresponding exposed conductors positioned in the cable guide slots, thereby to form an electrical connection with the corresponding inner conductors:

a non-conductive receptacle having a plurality of female contacts into which the plurality of corresponding male contacts are inserted, thereby to form an electrical connection with corresponding male contacts; and a conductive grounding plate electrically connected to the cable aligning member, for electrically connecting outer conductors of the plurality of coaxial cables to a ground terminal.

13. The electric connector according to claim 12, further comprising a holder cover installed on the cable holder, for maintaining the U-shaped bend of the inner conductors of the coaxial cables.

14. The electric connector according to claim 12, wherein the depressed portion of the non-conductive cable holder houses the cable aligning member.

* * * * *